US010273028B1

(12) United States Patent
Epstein

(10) Patent No.: US 10,273,028 B1
(45) Date of Patent: Apr. 30, 2019

(54) TOOL ASSEMBLY WITH AN O-RING TOOL BASE USED IN FORMING AND SEALING STATIONS OF HORIZONTAL, FORM, FILL AND SEAL, PACKAGING MACHINES

(71) Applicant: Moshe Epstein, Northbrook, IL (US)

(72) Inventor: Moshe Epstein, Northbrook, IL (US)

( * ) Notice: Subject to any disclaimer, the term of this patent is extended or adjusted under 35 U.S.C. 154(b) by 0 days.

(21) Appl. No.: 16/029,971

(22) Filed: Jul. 9, 2018

(51) Int. Cl.
*B65B 47/10* (2006.01)
*B65B 31/02* (2006.01)
(Continued)

(52) U.S. Cl.
CPC ..... *B65B 47/10* (2013.01); *B65B 31/021* (2013.01); *B65B 41/12* (2013.01); *B65B 51/10* (2013.01); *B65B 61/06* (2013.01)

(58) Field of Classification Search
CPC ..... B65B 47/10; B65B 31/021; B65B 41/12; B65B 51/10; B65B 61/06
See application file for complete search history.

(56) References Cited

U.S. PATENT DOCUMENTS 8,122,693 B1 * 2/2012 Buchko ..... B65B 7/164 493/211
2009/0100804 A1 * 4/2009 Bonneville ..... B65B 41/14 53/453

(Continued)

*Primary Examiner* — Andrew M Tecco
*Assistant Examiner* — Praachi M Pathak

(74) *Attorney, Agent, or Firm* — Steven Ivy P.C.

(57) ABSTRACT

Forming and sealing tool assemblies, utilized in conjunction with the commercially available, horizontal, form, fill and seal packaging machines, manually interchangeable with other forming and sealing tools assemblies, modifiable to accommodate the varying product shapes and sizes.

1. The forming tool assembly, designed to form the bottom portion of the package, is sub-divided into two sub-assemblies, the top and the bottom.
   a. The top sub-assembly, comprises of a forming chamber, and a forming heater. The bottom sub-assembly, releasably attached to a forming base containing a nozzle directing the vacuum and vent cycles, comprises of a forming o-ring tool base, a forming tool and a plurality of forming tool inserts.
   b. When utilizing the forming tool assembly, the packaging machine feeds into the forming station the first layer of the packaging film, where said packaging film is engaged by the top and the bottom sub-assemblies of the forming tool assembly, wherein
      i. the top sub-assembly projects the heat onto the packaging film, positioned directly above the forming pockets of the forming tool, and
      ii. the bottom sub-assembly, using the vacuum and vent cycles traveling from the vacuum system, through the forming base nozzle, through the air dispersing pocket shapes of the forming o-ring tool base, through the forming pockets of the forming tool, into the small air holes of the forming tool inserts, pulling the packaging film up against the bottom and side panels of said forming inserts, causing the packaging film to retain the shape of said forming tool inserts, thus pre-forming the bottom portion of the package.
2. The sealing tool assembly, designed to form the top portion of the package, is sub-divided into two sub-assemblies, the top and the bottom.
   a. The top sub-assembly, comprises of a sealing chamber, and a sealing heater. The bottom sub-assembly, releasably attached to a sealing base containing a (Continued)

nozzle directing the vacuum and vent cycles, comprises of a sealing o-ring tool base, a sealing tool with squeeze stoppers, and a sealing gasket.

b. When utilizing the sealing tool assembly, the packaging machine using the conveying chain, transfers the pre-formed, and filled with product, bottom portion of the package, into the sealing station. Here, the machine feeds the second layer of the packaging film, and engages the top and the bottom sub-assemblies of the sealing tool assembly, wherein
   i. the top sub-assembly, while generating the heat, is lowered and sandwiches together, the first layer (forming the bottom of the package) and the second layer (forming the top portion of the package) of the packaging film, against the seal gasket protected by the squeeze limiters, and
   ii. the bottom sub-assembly, using the vacuum and vent cycles traveling from the vacuum system, through the sealing base nozzle, through the air dispersing pocket shapes of the sealing o-ring tool base, into the sealing pockets of the sealing tool, evacuates the excess air from the interior of the package, sealing together the first and the second layer of the packaging film, completing the forming and sealing process of the package.

20 Claims, 17 Drawing Sheets

(51) Int. Cl.

| | |
|---|---|
| ***B65B 41/12*** | (2006.01) |
| ***B65B 51/10*** | (2006.01) |
| ***B65B 61/06*** | (2006.01) |

(56) References Cited

U.S. PATENT DOCUMENTS

2011/0216412 A1* 9/2011 Reed ..... B29D 11/00605 359/530
2014/0054831 A1* 2/2014 Emerson ..... B65B 47/10 264/571
2017/0297755 A1* 10/2017 Matheny ..... B65B 51/225
2018/0127132 A1* 5/2018 Cybart ..... B65B 9/08

* cited by examiner 110-120
TOP SUB-ASSEMBLY
OF THE FORMING
TOOL ASSEMBLY 210-220
TOP SUB-ASSEMBLY
OF THE SEALING
TOOL ASSEMBLY

TOOL ASSEMBLY WITH AN O-RING TOOL BASE USED IN FORMING AND SEALING STATIONS OF HORIZONTAL, FORM, FILL AND SEAL, PACKAGING MACHINES

FIELD OF THE INVENTION

The present invention relates to the general field of tooling, used in automated, horizontal, packaging machines.

BACKGROUND OF THE INVENTION

The present invention is a direct attempt to improve the functionality and performance aspects of commercially available, horizontal, form, fill and seal packaging machine. Specifically, improvement of the machine's forming and sealing tool assemblies with the focus on simplifying the tool changeover process, shortening the vacuum and vent cycle times, elimination of air leaks throughout the tooling structure, and the overall tooling durability.

To prevent vacuum/vent cycle leaks, the previously-available designs, of the forming and the sealing tools, relied heavily on a long and fragile seal, positioned on the top surface of both the forming and the sealing base.

Unlike the previous designs, the new design incorporates a plurality of small o-rings, positioned inside the forming and sealing o-ring tool base. Said o-rings, when interacting with the nozzle protruding from the forming or the sealing base, provide more dependable and more durable, method of sealing off the internal structure from the environment. The new design also reduces the air volume inside the tooling structure, allowing for more reliable and significantly shorter, vacuum and vent cycles.

The new forming and sealing tool assemblies offer four distinctive functional advantages, over previously-available forming/sealing tool designs:

1) Reliable vacuum and vent cycles. Accomplished by replacing the previously used seal, located on the top surface of the forming and sealing tool, with a plurality of o-rings located inside the o-ring hole of the forming and sealing tool, made to interact with a nozzle, guiding the vacuum/vent cycles. Whereby said o-ring, due to its size and a guarded position inside the o-ring hole, reduces the likelihood of air leaks and damage, frequently occurring during the tool changeover.

2) Accelerated machine indexing process. Accomplished by integrating into the forming and sealing base of the vacuum/vent cycles directing nozzles, allowing for directing vacuum/vent cycles pass the internal structure of the base, significantly reducing the amount of space filled by said vacuum/vent cycles, thereby accelerating the optimum cycle time of the machine.

3) Simplified tool changeover procedure. Accomplished by reducing the weight of the tooling needing replacement during the tool changeover process. Specifically, the tool changeover requires only the removal of the forming/sealing bottom sub-assemblies, allowing the forming and the sealing base to remain attached to the structure of the machine. This reduction of weight, allows an individual to exchange said sub-assemblies by using the removable handles, attachable to the forming/sealing tools.

4) Extended life cycle of the seal gasket. Accomplished by incorporating a plurality of squeeze limiters into the design of the sealing tool assembly. Specifically, the squeeze limiters are the rectangular stop blocks protruding from the side walls of the sealing tool, extending above the top surface of the sealing tool, absorbing the chamber's primary force, and preventing it from bottoming out on the seal gasket itself.

SUMMARY OF THE INVENTION

The following information is intended to be a brief summary of the invention, and as such, said information shall not be used as the means of limiting the scope of the invention:

Disclosed is a forming and a sealing tool assembly, utilized in conjunction with a commercially available, horizontal, form, fill and seal packaging machine, utilizing two layers of packaging film to complete a fully-enclosing product packaging.

Wherein the primary function of the forming station, is to use the first layer of said packaging film to form the bottom portion of the package, while the primary function of the sealing tool assembly, is to use the second layer of the packaging film to seal off the top portion of the package.

The forming tool assembly, is sub-divided into two sub-assemblies, the top and the bottom. The top sub-assembly, comprises of a forming chamber, and a forming heater. The bottom sub-assembly, releasably attached to a forming base containing a nozzle directing the vacuum and vent cycles, comprises of a forming o-ring tool base, a forming tool and a plurality of forming tool inserts.

When utilized, the packaging machine feeds into the forming station the first layer of the packaging film, where said packaging film is engaged by the top and the bottom sub-assemblies of the forming tool assembly, wherein (i) the top sub-assembly projects the heat onto the packaging film, positioned directly above the forming pockets of the forming tool, and (ii) the bottom sub-assembly, using the vacuum and vent cycles traveling in and out of the forming base nozzle, through the air dispersing pocket shapes of the forming o-ring tool base, and the forming pockets of the forming tool, into the small air holes of the forming tool inserts, pulling the packaging film up against the bottom and side panels of said forming inserts, causing the packaging film to retain the shape of said forming tool inserts, thus pre-forming the bottom portion of the package.

The sealing tool assembly, designed to form the top portion of the package, is also sub-divided into two sub-assemblies, the top and the bottom. The top sub-assembly, comprises of a sealing chamber, and a sealing heater. The bottom sub-assembly, releasably attached to a sealing base containing a nozzle directing the vacuum and vent cycles, comprises of a sealing o-ring tool base, a sealing tool with squeeze stoppers, and a sealing gasket.

When utilizing the sealing tool assembly, the packaging machine using the conveying chain, transfers the pre-formed and pre-filled with product, bottom portion of the package, into the sealing station. Here, the machine feeds the second layer of the packaging film, and engages the top and the bottom sub-assemblies of the sealing tool assembly, wherein (i) the top sub-assembly, while generating the heat, is lowered and sandwiches together, the first layer (forming the bottom of the package) and the second layer (forming the top portion of the package) of the packaging film, against the seal gasket protected by the squeeze limiters, and (ii) the bottom sub-assembly, using the vacuum and vent cycles traveling from the vacuum system, through the sealing base nozzle, through the air dispersing pocket shapes of the sealing o-ring tool base, into the sealing pockets of the sealing tool, evacuates the excess air from the interior of the package, sealing together the first and the second layer of the packaging film, completing the forming and sealing process of the package.

The new forming and sealing tool assemblies offer four distinctive functional advantages, over previously-available forming/sealing tool designs:

1) Reliable vacuum and vent cycles. Accomplished by replacing the previously used seal, located on the top surface of the forming and sealing tool, with a plurality of o-rings located inside the o-ring hole of the forming and sealing tool, made to interact with a nozzle, guiding the vacuum/vent cycles. Whereby said o-ring, due to its size and a guarded position inside the o-ring hole, reduces the likelihood of air leaks and damage, frequently occurring during the tool changeover.

2) Accelerated machine indexing process. Accomplished by integrating into the forming and sealing base of the vacuum/vent cycles directing nozzles, allowing for directing vacuum/vent cycles pass the internal structure of the base, significantly reducing the amount space filled by said vacuum/vent cycles, thereby accelerating the optimum cycle time of the machine.

3) Simplified tool changeover procedure. Accomplished by reducing the weight of the tooling needing replacement during the tool changeover process. Specifically, the tool changeover requires only the removal of the forming/sealing bottom sub-assemblies, allowing the forming and the sealing base to remain attached to the structure of the machine. This reduction of weight, allows an individual to exchange said sub-assemblies by using the removable handles, attachable to the forming/sealing tools.

4) Extended life cycle of the seal gasket. Accomplished by incorporating a plurality of squeeze limiters into the design of the sealing tool assembly. Specifically, the squeeze limiters are the rectangular stop blocks protruding from the side walls of the sealing tool, extending above the top surface of the sealing tool, absorbing the chamber's primary force, and preventing it from bottoming out on the seal gasket itself.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

Figure 15:
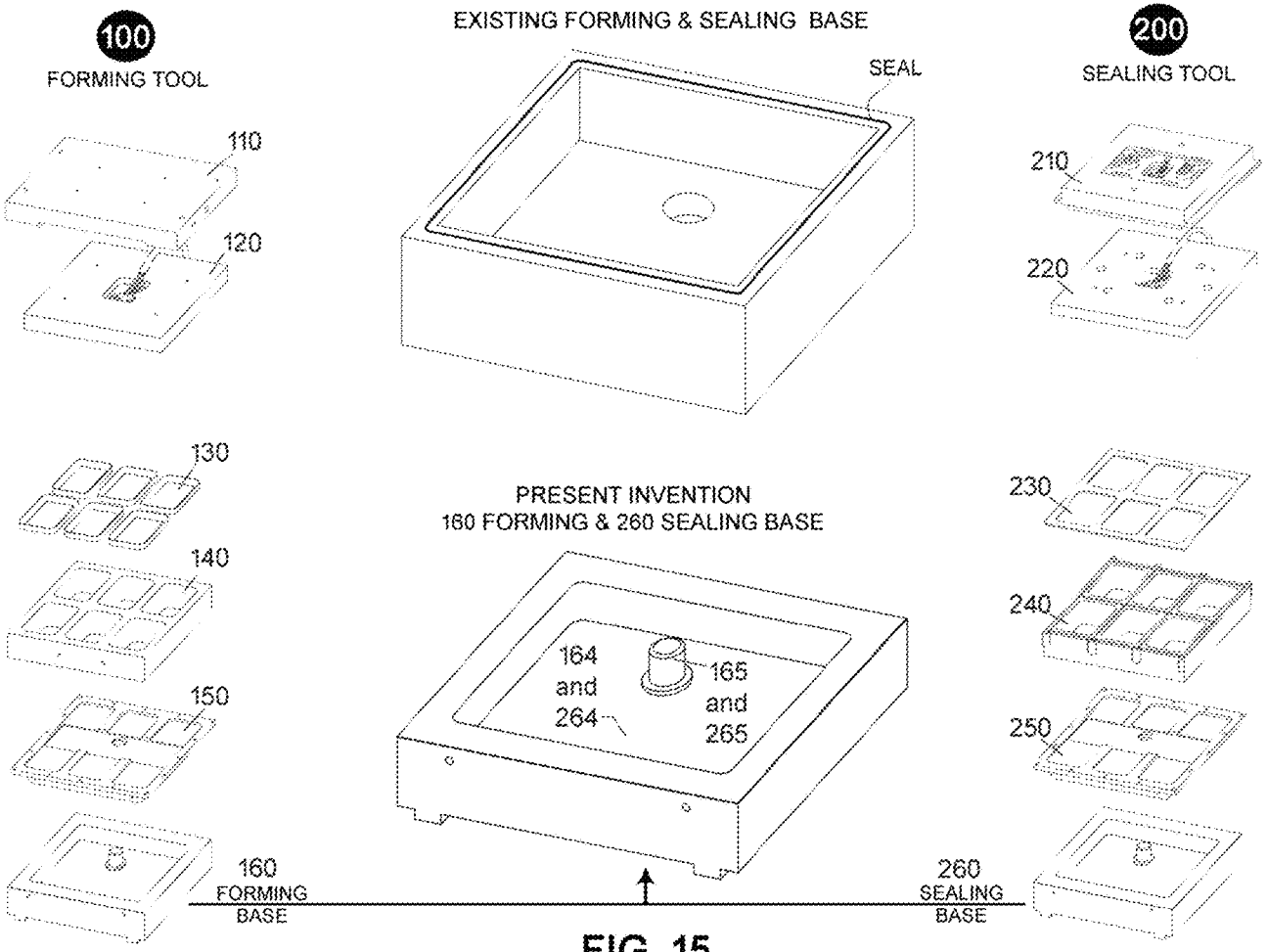
FIG. 15 is a fully exploded view of both the forming 100 and sealing 200 tool assemblies, including two enlarged perspective views of: 160 and 260 the present invention's forming/sealing base (indicating that the same, or similar, base is utilized by both the sealing and forming station); shown is also an existing forming and sealing base (prior art, housing a long seal, located on its top surface that follows the perimeter of the pocket), in accordance with an exemplary embodiment of the present invention.

A) a centrally-located hole, housing o-rings 157 designed to replace a long seal used in prior art, shown in FIG. 15;

B) a plurality of shallow pocket shapes 155/255 of varying shapes and sizes, with an annotation "the shape of cutouts is dedicated by the size and shape of the product";

C) a plurality of small, bi-directional arrows, made to represent areas of the shallow pocket shapes, made to allow free flow of air, even after said o-ring base is attached to the forming/sealing tool; and D) a large, bi-directional arrow, titled "vacuum" including its annotation "vacuum & vent cycle", designed to show the main inlet/outlet of said air/vacuum, in accordance with an exemplary embodiment of the present invention.

Figure 17:
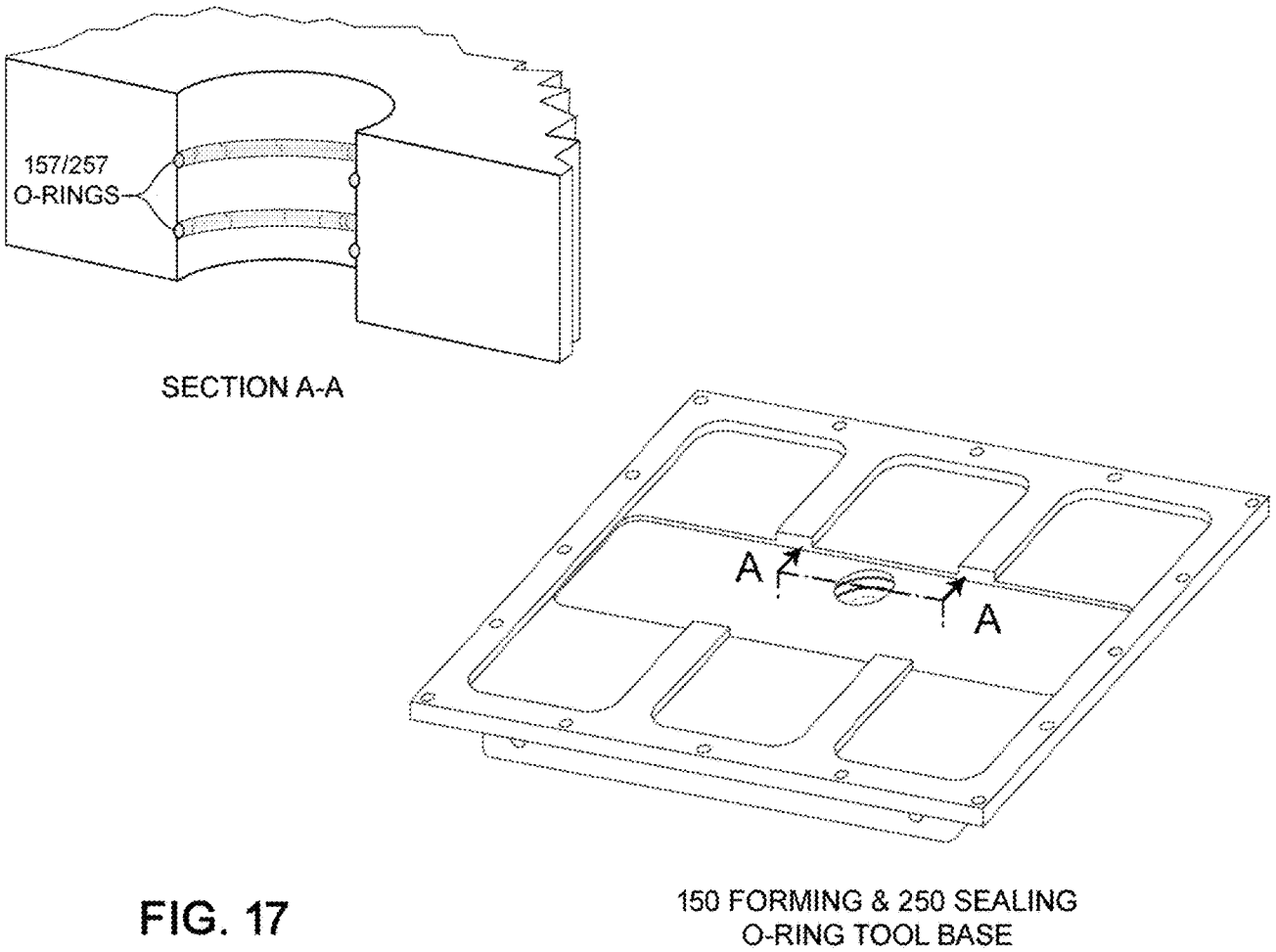

FIG. 17 is perspective view of the forming 150 and sealing 250 o-ring tool base, and a sectional view A-A, of its centrally-located o-ring hole 156/256, housing two o-rings 157/257, in accordance with an exemplary embodiment of the present invention.

Figure 18:
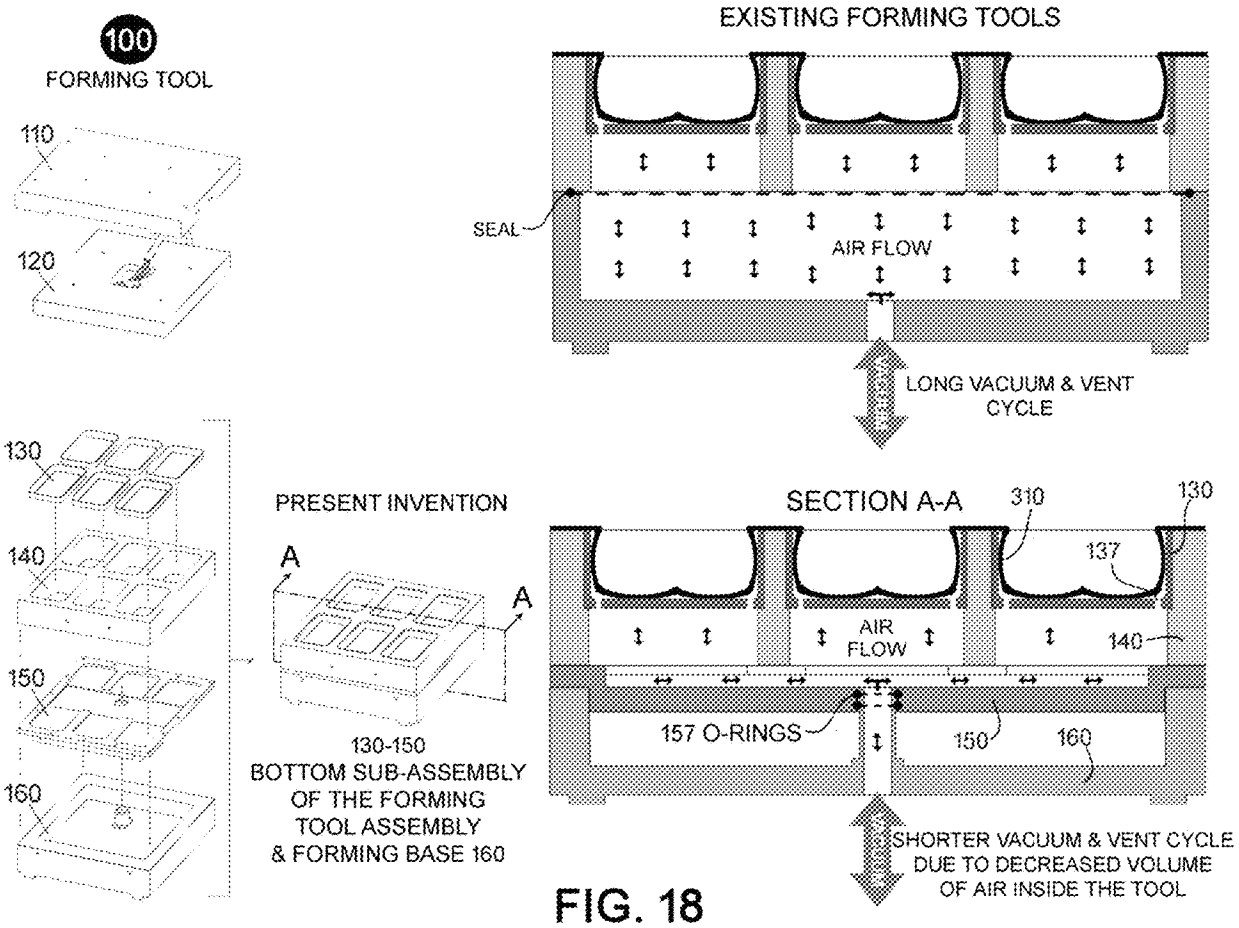

FIG. 18 is a fully exploded view of the forming tool assembly, and a perspective view of the bottom sub-assembly of the forming tool assembly (comprising of: tool inserts, forming tool, forming o-ring base) attached to the forming base, with its sectional view A-A; plus a similar sectional view of an existing forming tool, designed to show:

A) a sectional view of an existing forming tool base (prior art) and (i) the location of its long seal; (ii) positioning of the tool inserts, and the position of the first layer of the packaging film, pre-formed into the bottom portion of the package; (iii) a plurality of small bi-directional arrows, to emphasize the excessively large air flow area, which must be filled to generate the vacuum and vent cycles; (iv) a large bi-directional arrow (titled "vacuum"), showing the main inlet/outlet of said air, including an annotation "long vacuum & vent cycle"; and B) current invention's forming o-ring tool base, and (i) the location of the o-rings, made to replace the long seal used in the prior art; (ii) including the positioning of the tool inserts and contained therein the first layer of the packaging film, forming the bottom portion of the package; (iii) a plurality of small bi-directional arrows, to emphasize the reduction in the air flow area, required to generate the vacuum and vent cycles; (iv) a large bi-directional arrow (titled "vacuum"), showing the main inlet/outlet of said air, including an annotation "shorter vacuum and vent cycle due to decreased volume of air inside the tool," in accordance with an exemplary embodiment of the present invention.

Figure 19:
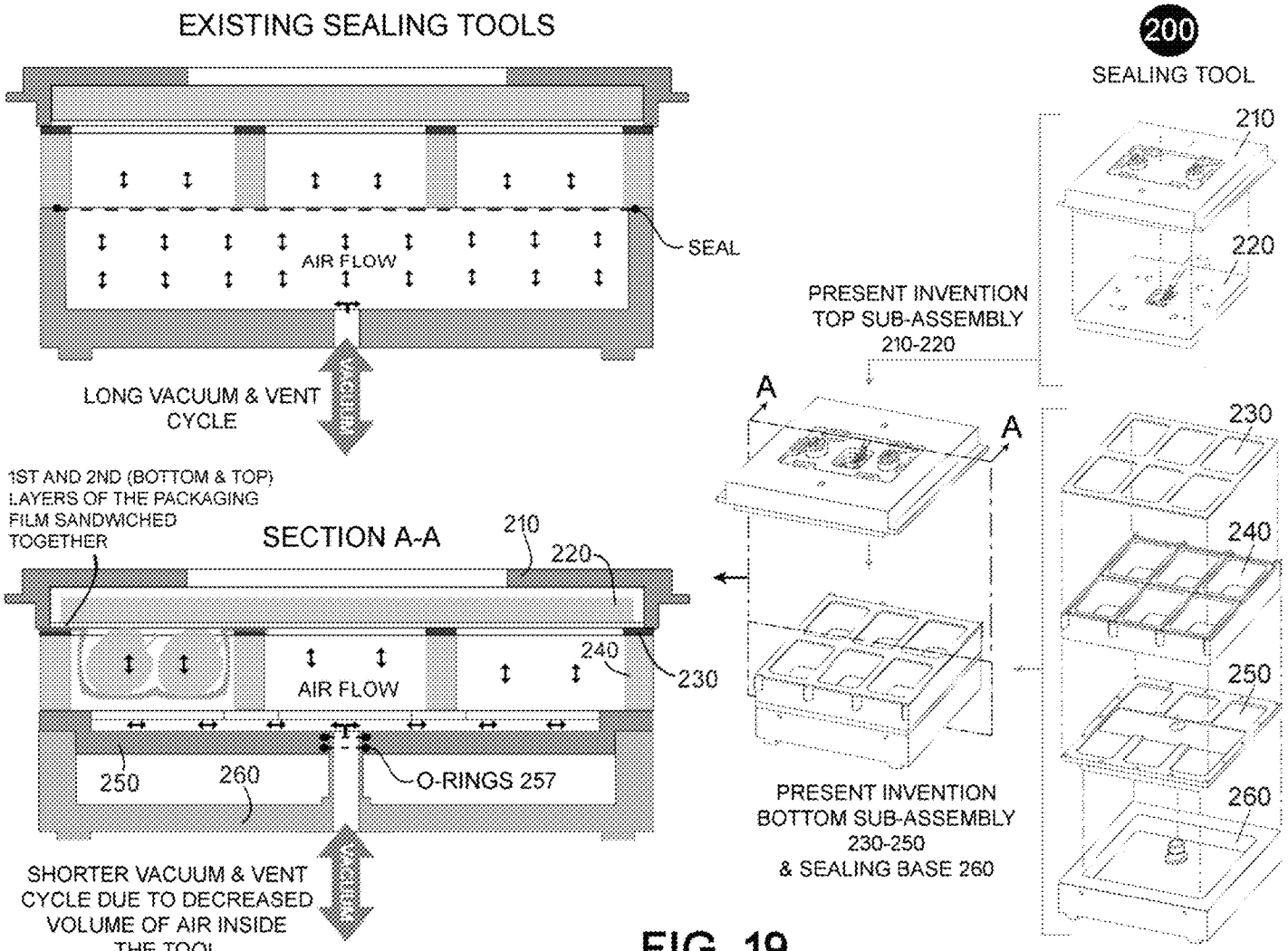

FIG. 19 is a fully exploded view of the sealing tool assembly, and a perspective view of two sub-assemblies: 210-220 the top sub-assembly of the sealing tool assembly (comprising of: sealing chamber and sealing heater) and the 230-250 bottom sub-assembly of the sealing tool assembly (comprising of: seal gasket, sealing tool, sealing o-ring tool base), attached to the forming base, with its sectional view A-A; plus, a similar sectional view of an existing (prior art) forming tool, designed to show:

A) in said prior art (i) the location of its long seal; (ii) a plurality of small bi-directional arrows, to emphasize the excessively large air flow area, which must be filled to generate the vacuum and vent cycles; (iii) a large bi-directional arrow (titled "vacuum"), showing the main inlet/outlet of said air, including an annotation "long vacuum and vent cycle"; and B) current invention's sealing o-ring tool base, and (i) the location of the o-rings, made to replace the long seal used in the prior art; (ii) a plurality of small bi-directional arrows, to emphasize the reduction in the air flow area, required to generate the vacuum and vent cycles; (iii) a large bi-directional arrow (titled "vacuum"), showing the main inlet/outlet of said air, including an annotation "shorter vacuum and vent cycle due to decreased volume of air inside the tool", in accordance with an exemplary embodiment of the present invention.

Figure 20:
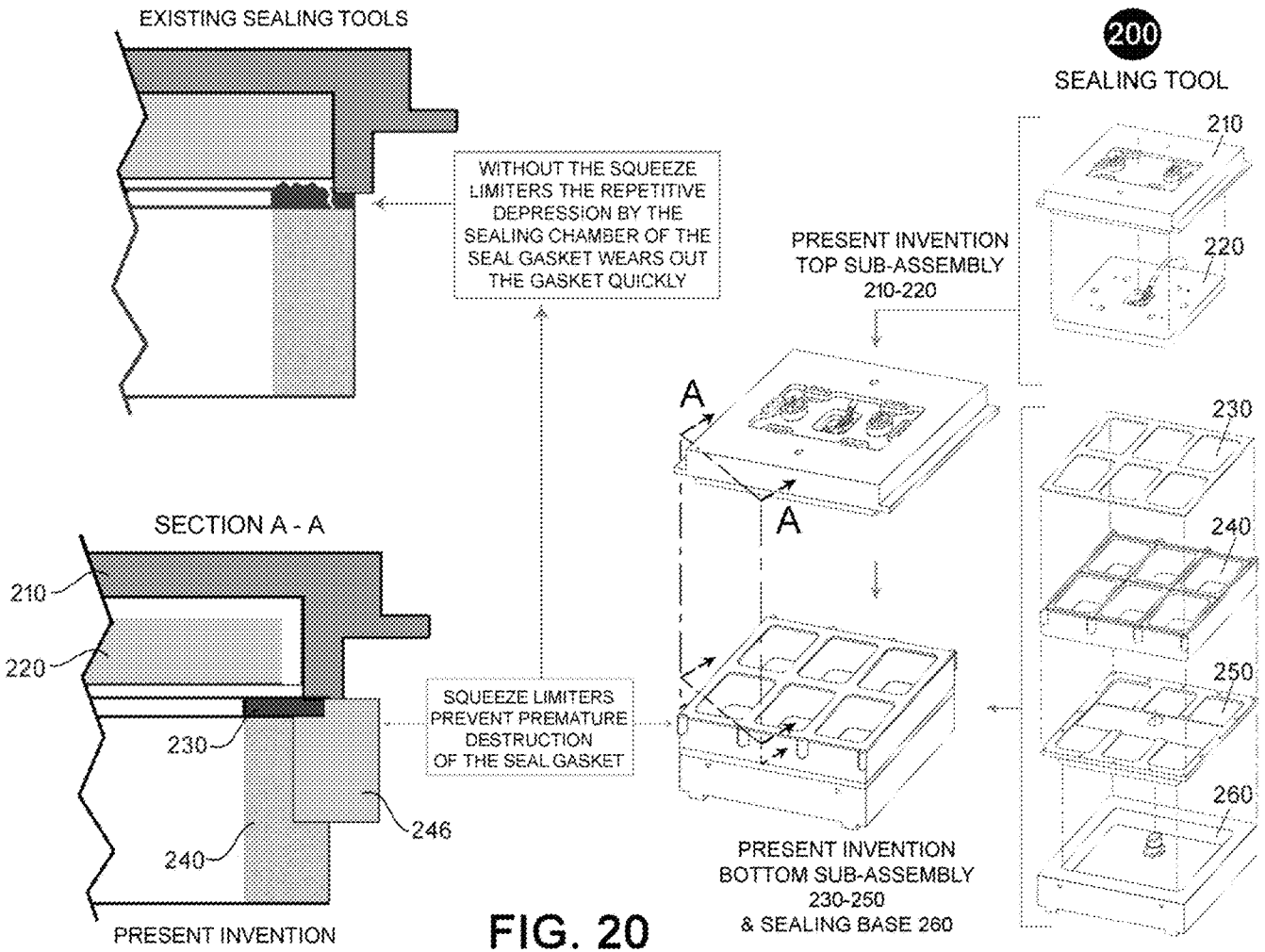

FIG. 20 is a fully exploded view of the sealing tool assembly, and a perspective view of two sub-assemblies: 210-220 the top sub-assembly of the sealing tool assembly (comprising of: sealing chamber and sealing heater) and the 230-250 bottom sub-assembly of the sealing tool assembly (comprising of: seal gasket, sealing tool, sealing o-ring tool base), attached to the forming base, with its sectional view A-A; plus a similar sectional view of an existing (prior art) forming tool, designed to:

A) shows the existing sealing tool assembly in closed position, with focus on the point of contact between the sealing chamber and the seal gasket, with an annotation "repetitive depression of the seal gasket wears out the gasket quickly"; and B) shows the current invention's sealing tool assembly in closed position, with focus on the point of contact between the sealing chamber and the seal gasket, with an annotation "squeezing limiters prevent premature destruction of the seal gasket", in accordance with an exemplary embodiment of the present invention.

DESCRIPTIVE KEY

100—forming tool assembly
- 110-120 top sub-assembly
- 110—forming chamber
  - 111—top surface
  - 112—bottom surface
  - 113—mounting holes
  - 114—retaining clearance holes
- 120—forming heater
  - 121—top surface
  - 122—bottom surface
  - 123—power cable
  - 124—retaining threaded holes
- 130-150 bottom sub-assembly
- 130—forming tool inserts
  - 131—side panel
  - 132—bottom panel
  - 133—air holes
- 140—forming tool
  - 141—top surface
  - 142—bottom surface
  - 143—side walls
  - 144—forming pocket
  - 145—retaining threaded holes
  - 146—handle threaded holes
    - 147—removable handles
- 150—forming O-RING tool base
  - 151—top surface
  - 152—bottom surface
  - 153—flange
  - 154—retaining clearance holes
  - 155—pocket shapes
  - 156—o-ring hole
  - 157—o-rings
- 160—forming base
- 161—top surface
- 162—bottom surface
- 163—side walls
- 164—pocket
- 165—nozzle
- 166—retaining threaded holes

200—sealing tool assembly
- 210-220 top sub-assembly
- 210—sealing chamber
  - 211—top surface
  - 212—bottom surface
  - 213—heater pocket
  - 214—mounting holes
  - 215—retaining clearance holes
- 220—sealing heater
  - 221—top surface
  - 222—bottom surface
  - 223—power cable
  - 224—retaining threaded holes
- 230-250 bottom sub-assembly
- 230—seal gasket
  - 231—forming cutouts
- 240—sealing tool
  - 241—top surface
  - 242—bottom surface
  - 243—side walls
  - 244—sealing pockets
  - 245—retaining threaded holes
  - 246—squeeze limiters
  - 247—handle threaded holes
    - 248—removable handles
- 250—sealing O-RING tool base
  - 251—top surface
  - 252—bottom surface
  - 253—flange
  - 254—retaining clearance holes
  - 255—pocket shapes
  - 256—o-ring hole
  - 257—o-rings
- 260—sealing base
- 261—top surface
- 262—bottom surface
- 263—side walls
- 264—pocket
- 265—nozzle
- 266—retaining threaded holes

300—horizontal form, fill and seal packaging machine
- 310—packaging film
- 320—bottom film roll unwind station (the first layer of the packaging film)
- 330—conveying chain
- 340—forming/form station—using the forming tool assembly 100
- 350—fill station
- 360—top film roll unwind station (the second layer of the packaging film)
- 370—sealing/seal station—using the sealing tool assembly 200
- 380—cut station
- 390—power and control station
- 391—pneumatic cylinders
- 392—electric motors
- 393—vacuum pump
- 400—packaged product

DETAILED DESCRIPTION OF THE PREFERRED EMBODIMENT

Figures 1, 2, 3, 4:
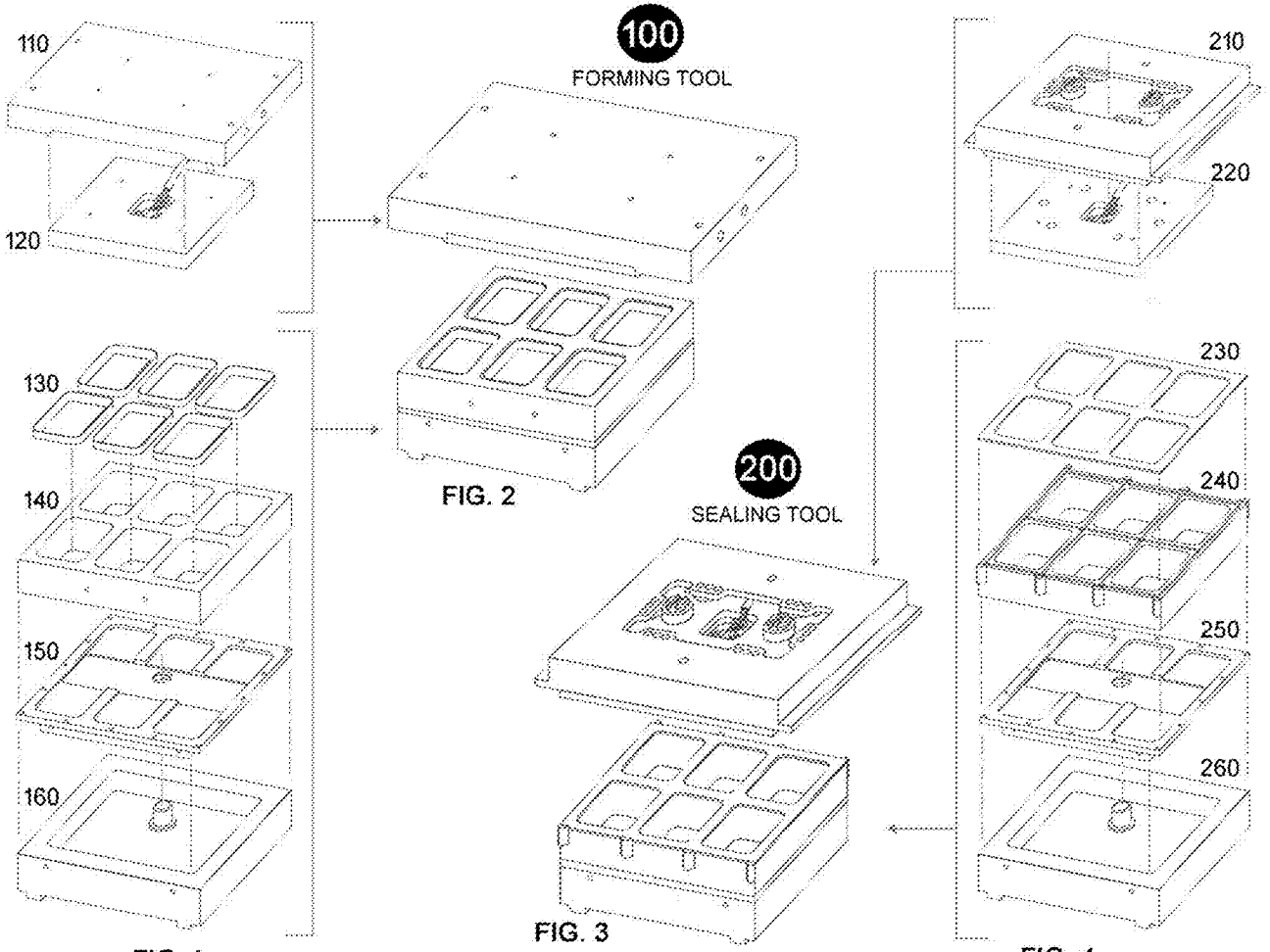
FIG. 1 is a fully exploded view of a forming tool assembly, providing a perspective view of each individual component, incorporated in said forming tool assembly, comprising of: 110 forming chamber; 120 forming heater; 130 forming tool inserts; 140 forming tool; 150 forming o-ring tool base; 160 forming base; in accordance with an exemplary embodiment of the present invention.
FIG. 2 shows two sub-assemblies of the forming tool assembly: 110-120 the top sub-assembly of the forming tool assembly, comprising of: 110 the forming chamber; 120 the forming heater; 130-150 the bottom sub-assembly of the forming tool assembly, comprising of: 130 forming tool inserts; 140 forming tool; 150 forming o-ring tool base; said bottom sub-assembly is shown attached to 160 forming base, in accordance with an exemplary embodiment of the present invention.
FIG. 3 shows two sub-assemblies of the sealing tool assembly: 210-220 the top sub-assembly of the sealing tool assembly, comprising of: 210 sealing chamber; 220 sealing heater; 230-250 the bottom sub-assembly of the sealing tool assembly, comprising of: 230 seal gasket; 240 sealing tool; 250 sealing o-ring tool base; said bottom sub-assembly is shown attached to 260 sealing base, in accordance with an exemplary embodiment of the present invention.
FIG. 4 is a fully exploded view of the sealing tool assembly, providing a perspective view of each individual component, incorporated in said sealing tool assembly, comprising of: 210 sealing chamber; 220 sealing heater; 230 seal gasket, 240 sealing tool; 250 sealing o-ring tool base; 260 sealing base, in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

Disclosed is a forming 100 tool assembly (shown in FIGS. 1 and 2) and a sealing tool assembly 200 (shown in FIGS. 3 an 4), utilized in conjunction with the commercially available, horizontal, form, fill and seal packaging machine 300, shown in FIGS. 9, 10, 11 and 12.

When utilized, both the forming 100 and the sealing 200 tool assemblies, must be mounted to the structure of the packaging machine 300, which via pneumatic cylinders 391 and/or electric motors 392, extends/retracts said tools 100/

200 in vertical motion. Said motion is functionally synchronized, via the power and controls station 390, with the other stations of the machine 300, including the application of controlled, bi-directional air/gas flow, defined herein as "the vacuum and vent cycles". Wherein said mounting location of the forming tool assembly 100 is defined herein as the forming station 340, and the location for mounting the sealing tool assembly 100, is defined as the sealing station 370 (referenced in FIG. 9).

Figure 9:
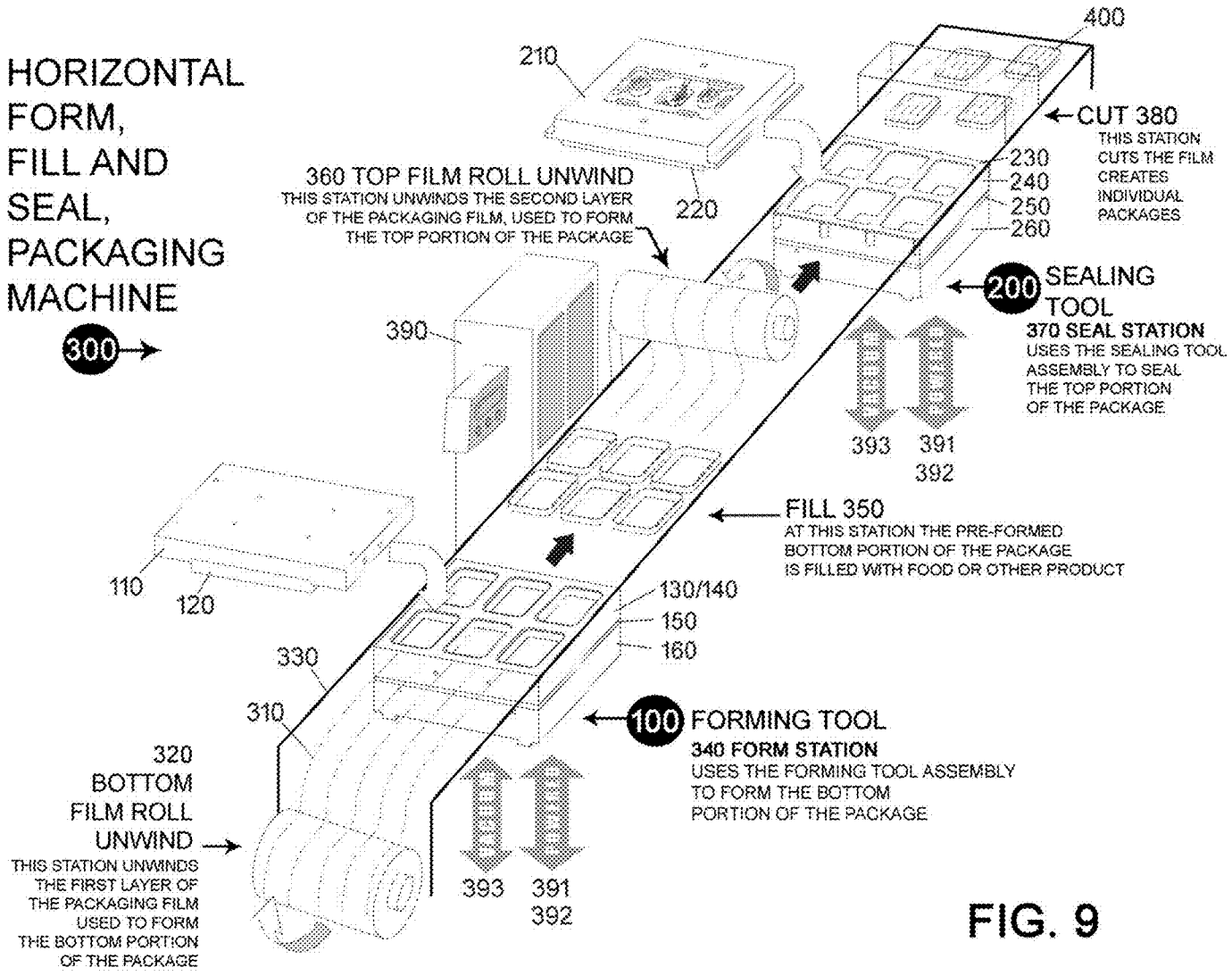
FIG. 9 is a simplified, perspective view of a horizontal, form, fill and seal packaging machine, designed to show the positioning of the forming and sealing tool assemblies inside said machine, and list associated therewith, functional stations, including: 320 bottom packaging film roll unwind; 340 form station; 350 fill station; 360 top packaging film roll unwind; 370 seal station; 380 cut station; 330 conveying chain; 390 vacuum pump system; 392 electric motors and 391 pneumatic cylinders; 390 power/control station, in accordance with an exemplary embodiment of the present invention.
Figure 10:
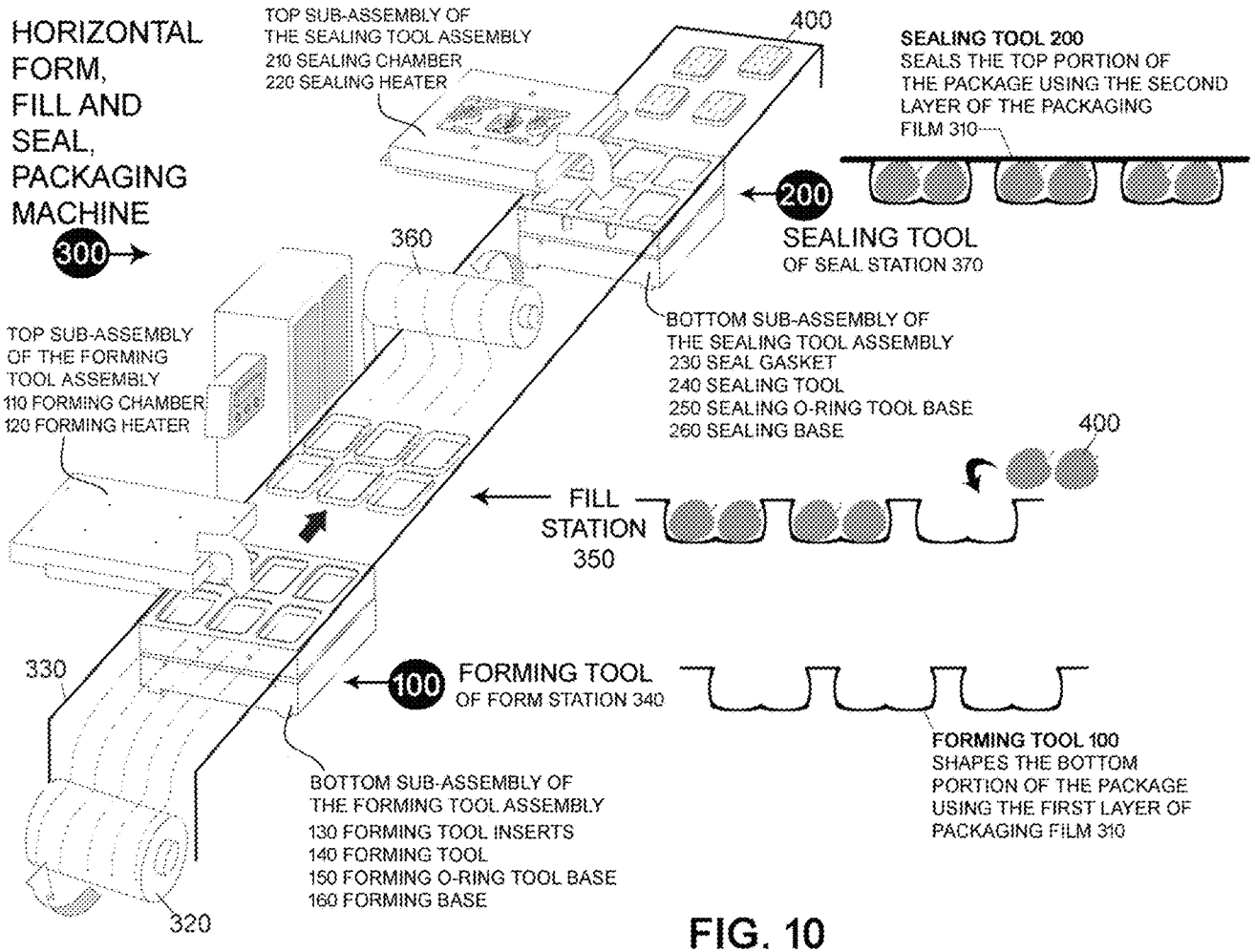
FIG. 10 is a simplified, perspective view of a horizontal, form, fill and seal packaging machine, listing the location and the components of: 110-120 the top and 130-150 the bottom sub assemblies of the forming tool assembly (including 160 forming base), and 210-220 the top and the 230-250 bottom sub assemblies of the sealing tool assembly (including 260 sealing base); shown are also, three sectional views, depicting the shapes of the packaging film at three different functional stations of said packaging machine, including 340 the form station (where the bottom portion of the package is formed); 350 the fill station (where the product is placed inside the bottom portion of the package); 370 the sealing station (where the top layer of the packaging film is sealed to the bottom portion of the package), in accordance with an exemplary embodiment of the present invention.
Figure 11:
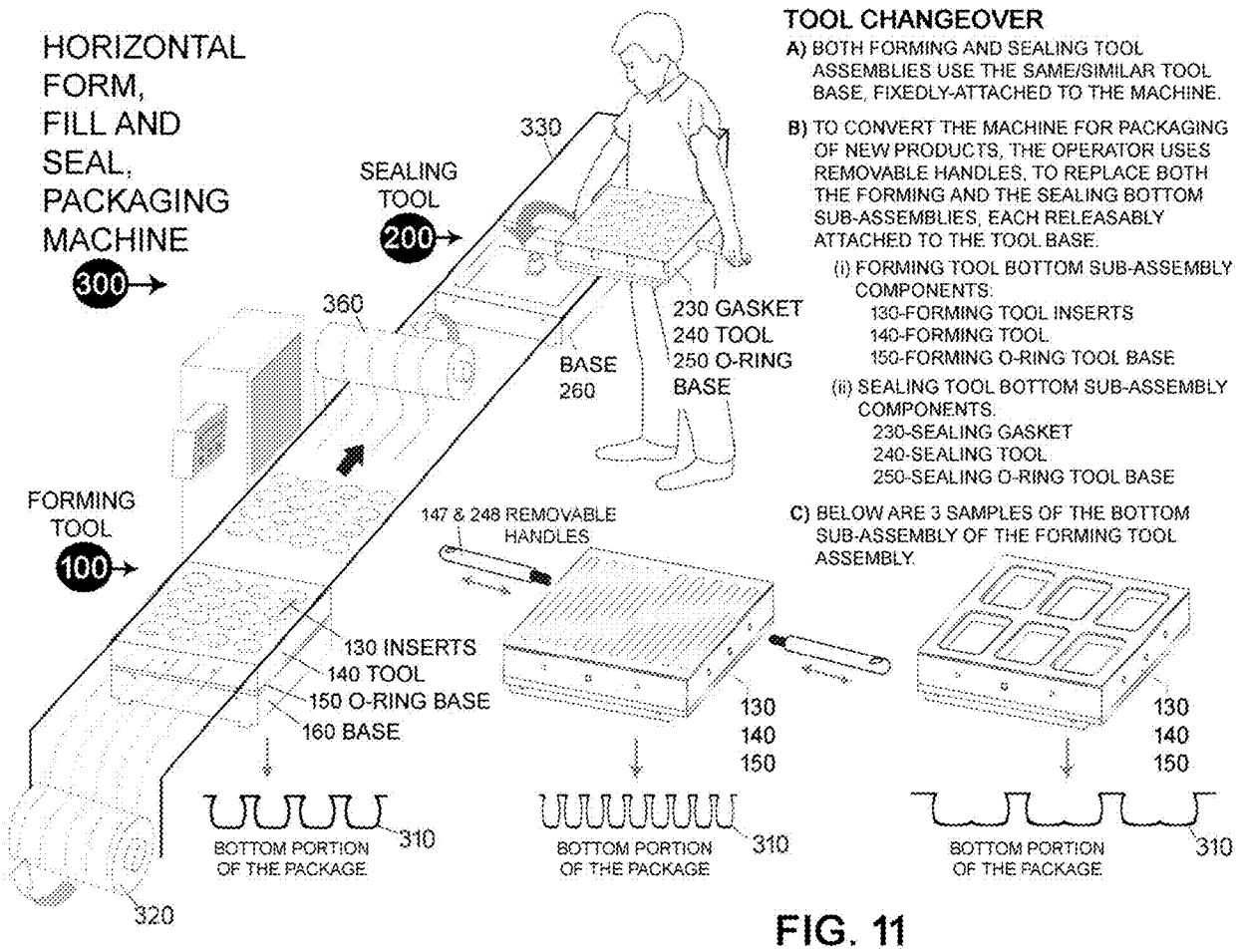
FIG. 11 is a simplified, perspective view of the above-defined packaging machine, showing an individual using the removable handles to conduct a changeover of the bottom sub-assembly of the sealing tool assembly (replacing: 230 sealing gasket, 240 sealing tool, 250 sealing o-ring tool base); displayed are also three samples of the bottom sub-assembly of the forming tool assembly (each with differently shaped tool inserts to accommodate the varying product shapes and sizes), in accordance with an exemplary embodiment of the present invention.
Figure 12:
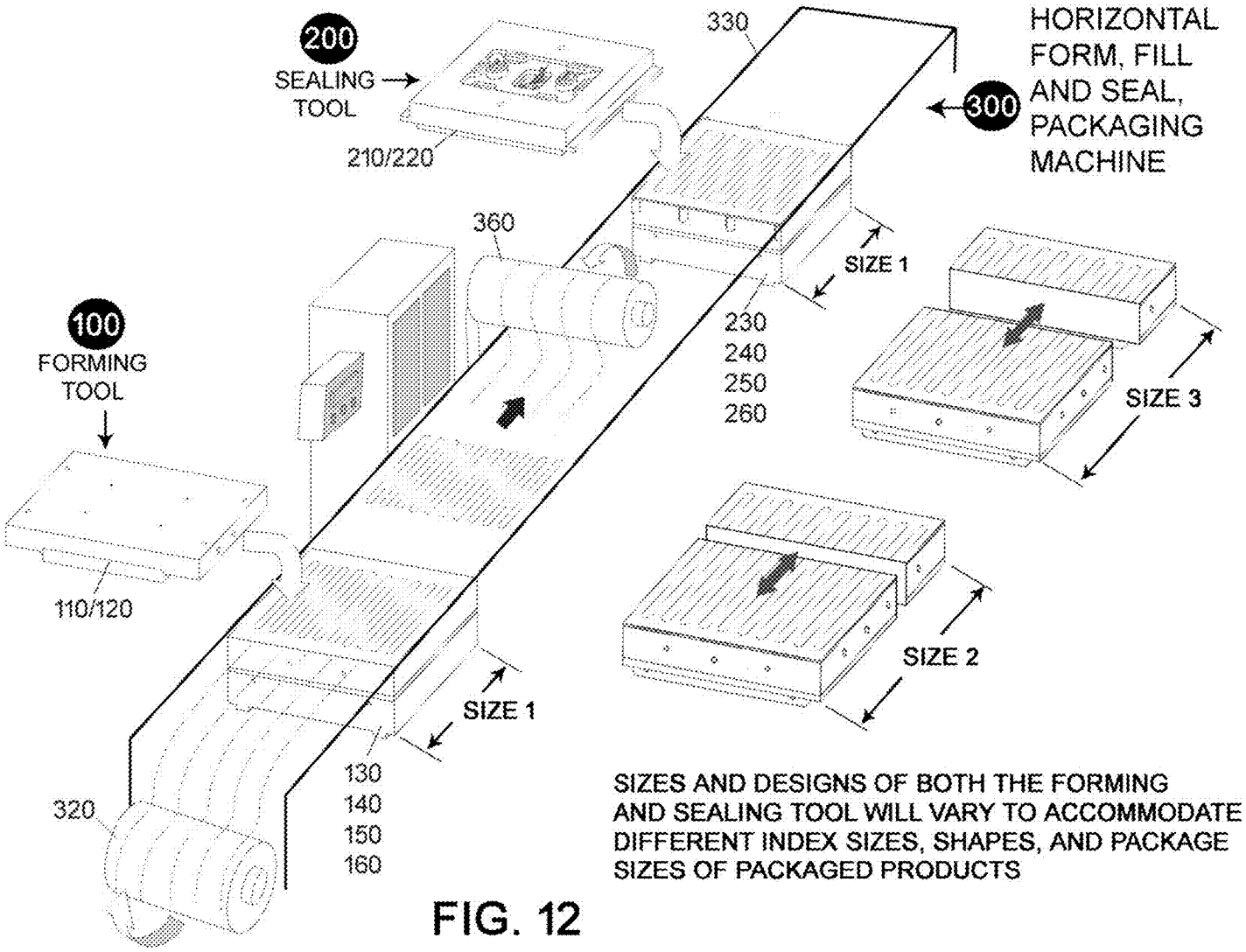
FIG. 12 is a simplified, perspective view of the above-defined packaging machine, and attached thereto the forming and sealing tool assemblies, showing three different sizes of the forming tool assembly, with the caption "sizes and designs of both the forming and sealing tool will vary to accommodate different index sizes, shapes, and package sizes of packaged products", in accordance with an exemplary embodiment of the present invention.

To compete the product packaging process, said packaging machine 300 uses two layers of the packaging film 310, which via a conveying chain 330, are indexed between the functional stations of the machine 320-380, enabling the progression in the horizontal plane ("indexing") of the product packaging process (shown in FIGS. 9, 10 and 11).

The primary function of the forming station 200, is to use the first layer of said packaging film 310 to form the bottom portion of the package (shown in FIGS. 10 and 18); while the primary function of the sealing tool assembly, is to use the second layer of the packaging film 310 (shown in the upper-right corner of FIG. 10) to seal off the top portion of the package, thus completing the packaging process of the product.

The packaging process creates groups of packages, connected to each other along their edges. To separate said packages, a cut station 380 is utilized at the end of the machine's 300 operational flow (shown in FIG. 9).

Figure 13:
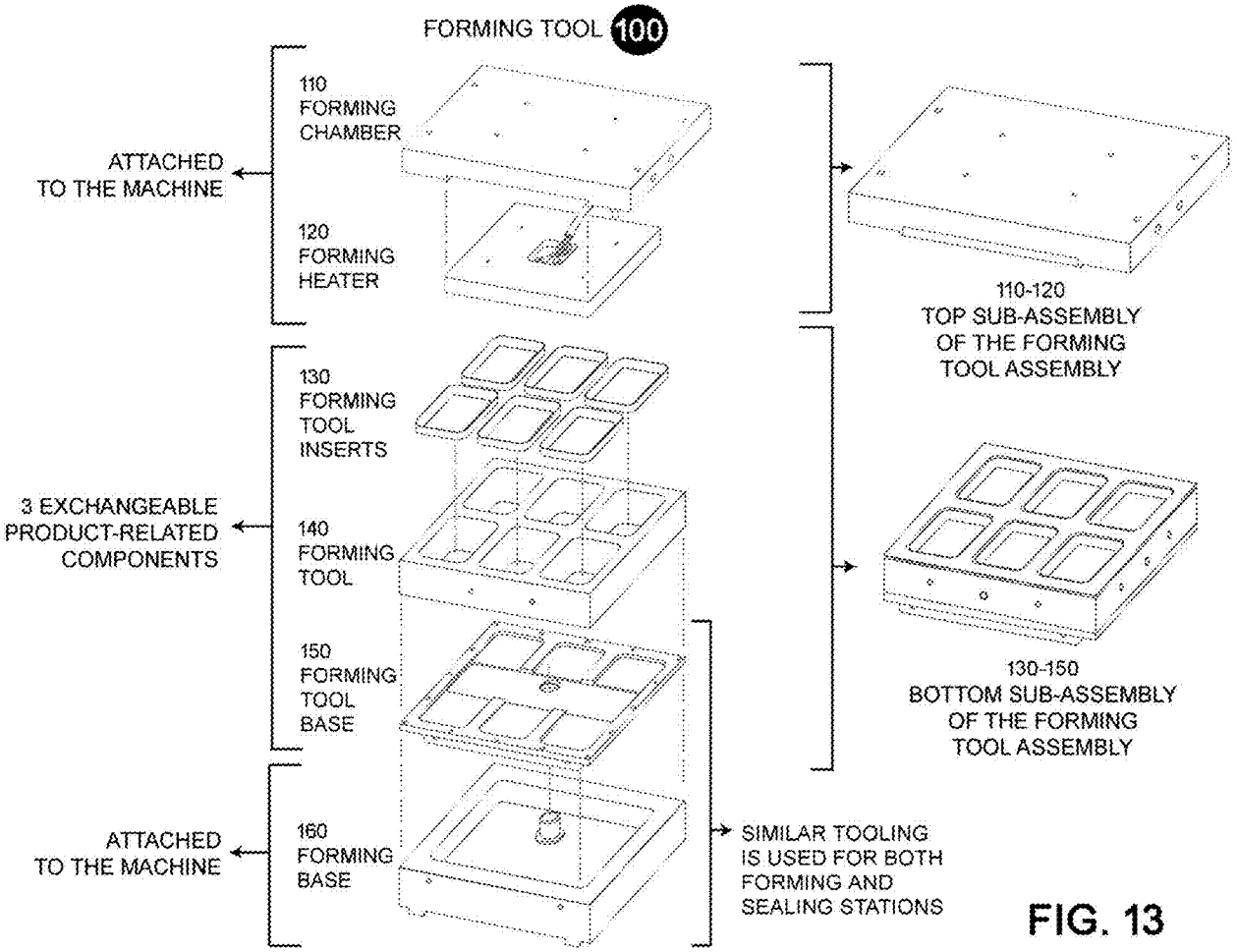
FIG. 13 is a fully exploded view of the forming tool assembly, providing a perspective view of each individual component and two sub-assemblies: 110-120 the top sub-assembly of the forming tool assembly (comprising of: 110 forming chamber, 120 forming heater; annotated "attached to the machine") indicating that this sub-assembly does not have to be removed during the tool exchange process; 130-150 the bottom sub-assembly of the forming tool assembly (comprising of: 130 forming tool inserts, 140 forming tool, 150 forming o-ring tool base; annotated "3 exchangeable product-related components") indicating that this sub-assembly is a part of the tool exchange process, necessary to accommodate different shapes/sizes of packaged products; and 160 forming base (annotated "attached to the machine") indicating that this sub-assembly does not have to be removed during the tool exchange process, in accordance with an exemplary embodiment of the present invention.

The forming tool assembly 100, is divided into two sub-assemblies: (1) a top sub-assembly 110-120 (shown in FIGS. 5 and 13), comprising of: (i) a forming chamber 110 (ii) and a forming heater 120; (2) and a bottom sub-assembly 130-150 (shown in FIGS. 6 and 13), comprising of (i) forming tool inserts 130, (ii) a forming tool 140, (iii) a forming o-ring base 150.

Figure 5:
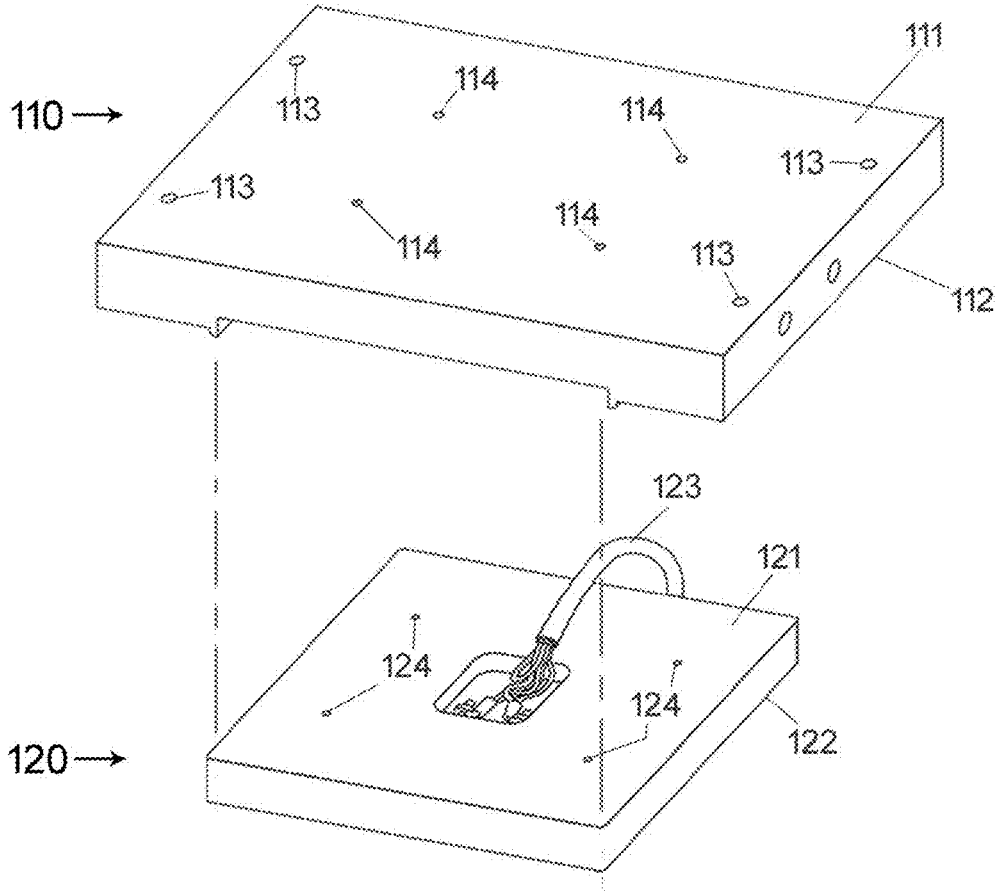
FIG. 5 is an exploded view of the top sub-assembly of the forming tool assembly, comprising of: 110 forming chamber; 120 forming heater, in accordance with an exemplary embodiment of the present invention.

The top sub-assembly's forming chamber 110, shown in FIG. 5 (comprising of a top surface 111, a bottom surface 112, mounting holes 113, and retaining clearance holes 114) is fixedly attached to the forming heater 120 (comprising of a top surface 121, a bottom surface 122, a power cable 123, retaining threaded holes 124) by connecting with screws (or other mechanical means) the clearance holes 114 to the threaded holes 124, located on the top surface 121 of the heater 120.

The forming chamber 110 is fixedly attached to the forming station 340 of the machine 300, using screws (or other mechanical means) and the mounting holes 113, shown in FIG. 5. Wherein said forming station 340 provides means of controllable vertical motion of said forming chamber 110, including but not limited to pneumatic cylinders 391 and/or electric motors 392.

Figure 6:
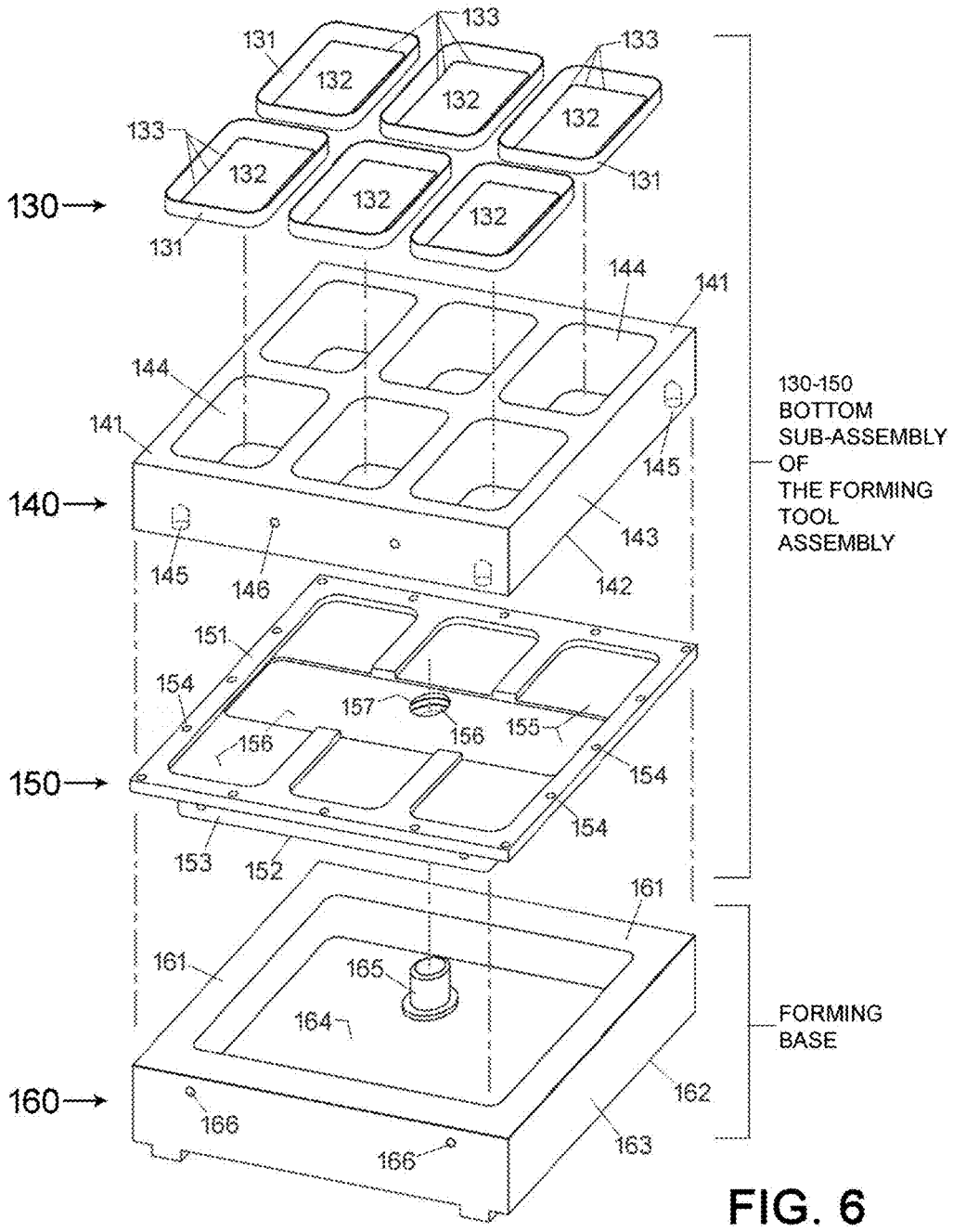
FIG. 6 is an exploded view of the bottom sub-assembly of the forming tool assembly (comprising of: 130 forming tool inserts, 140 forming tool, 150 forming o-ring tool base) and 160 forming tool base, in accordance with an exemplary embodiment of the present invention.

As shown in FIGS. 6 and 18, the bottom sub-assembly's forming tool inserts 130 (comprising of side panels 131, bottom panels 132, and air holes 133) fit slidably inside the forming pockets 144 of the forming tool 140 (comprising of top surface 141, bottom surface 142, side walls 143, forming pocket 144, retaining threaded holes 145, handle threaded holes 146).

Figure 16:
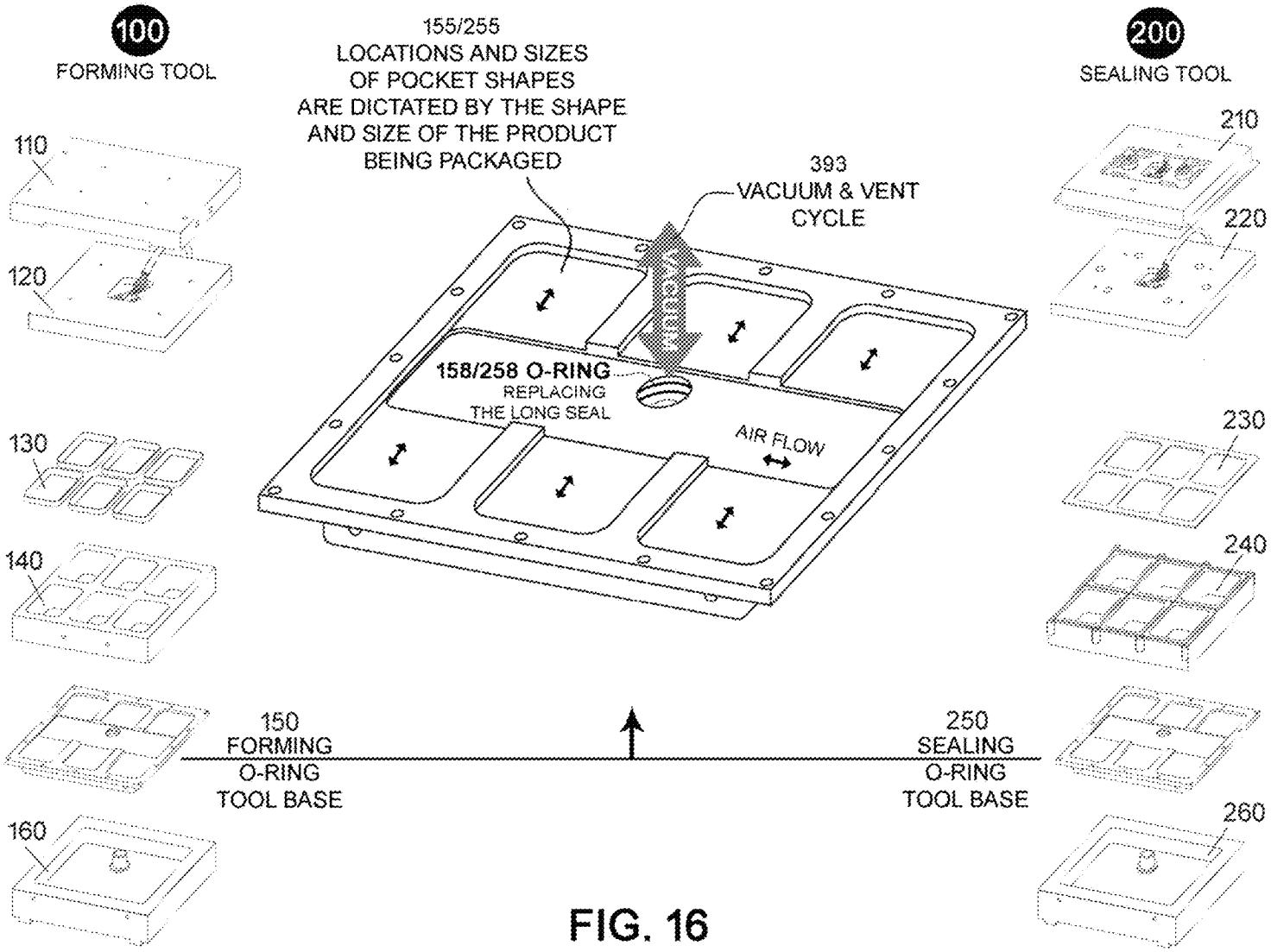
FIG. 16 is a fully exploded view of both the forming 100 and sealing 200 tool assemblies, including an enlarged view of the forming 150 and the sealing 250 o-ring tool base, designed to show.

Said forming tool 140 (shown in FIGS. 6, 16 and 18), is fixedly attached to the forming o-ring tool base 150, shown in FIGS. 6, 15, 17 and 18, (comprising of top surface 151, bottom surface 152, flange 153, retaining clearance holes 154, pocket shapes 155, o-ring hole 156, o-rings 157), wherein said connection between the forming tool 140 and the o-ring-tool base 150 is via the retaining clearance holes 154 and the retaining threaded holes 145, connected with screws (or other mechanical means and/or adhesives).

The bottom sub-assembly 130-150 is releasably attached to a forming base 160 (comprising of top surface 161, bottom surface 162, side walls 163, pocket 164, nozzle 165, and retaining threaded holes 166). The forming base is fixedly attached to the machine 300, via a hard air fitting. Said fitting is connecting the vacuum pump 393 to the inlet of the nozzle 165 of the forming base 160 (located on the bottom surface 162 of the base 160).

As shown in FIG. 9, the forming tool assembly 100 is positioned toward the beginning of the machine's 300 operational flow, and utilizes the packaging film 310 received from the bottom film roll unwind station 320. Once the packaging film 310 reaches the forming station 340, the pneumatic cylinders 391 move the top sub-assembly 110-120 downward, and the bottom sub-assembly 130-150 upward, sandwiching said first layer of the packaging film 310 between the forming chamber 110 and the forming tool 140.

Next, the machine 300 initiates the vacuum and vent cycle, generated by the vacuum pump 393 and the power/control station 390. The vacuum and vent cycle travels from the pump system 393 into the nozzle 165 of the forming base 160 (shown in FIGS. 6 and 15), and from said nozzle 165 into the o-ring tool base 150 (shown in FIG. 16). The connection between said nozzle 165 and the base 150 is via an o-ring hole 156 (shown in FIGS. 16 and 17), which holds a plurality of o-rings 157, allowing said nozzle 165 to slidably fit inside said o-ring hole 156, enabling the access of said vacuum and vent cycles to the top surface 151 of the forming o-ring tool base 150.

At the o-ring tool base 150, the vacuum and vent cycles is redistributed, via the shallow pocket shapes 155 (shown in FIG. 16), and directed into the forming pockets 144 of the forming tool 140, which house the forming inserts 130. Next, the vacuum and vent cycle penetrates said forming inserts 130 via a plurality of small air holes 133 (shown in FIG. 6), located in the side 131 and/or bottom 132 panels of each insert 130.

Once inside the forming inserts 130, the vacuum and vent cycles can draw the packing film 310 down against the internal structure of said tool inserts 130, as shown in FIG. 18. Said internal structure of tool inserts 130 is exposed to the heat supplied by the forming heater 120, causing the packaging film 310 to change its molecular structure, and by doing so retains the shape of the tools insert 130, thereby forming the bottom portion of the package.

Next, the packaging machine 300 indexes the pre-formed bottom portion of the packages to the fill station 350, when an individual or an automated system, fills said bottom portion of packages with the product. Once the product filling step has been finalized, the partially completed package is indexed to the sealing station 370.

Figure 14:
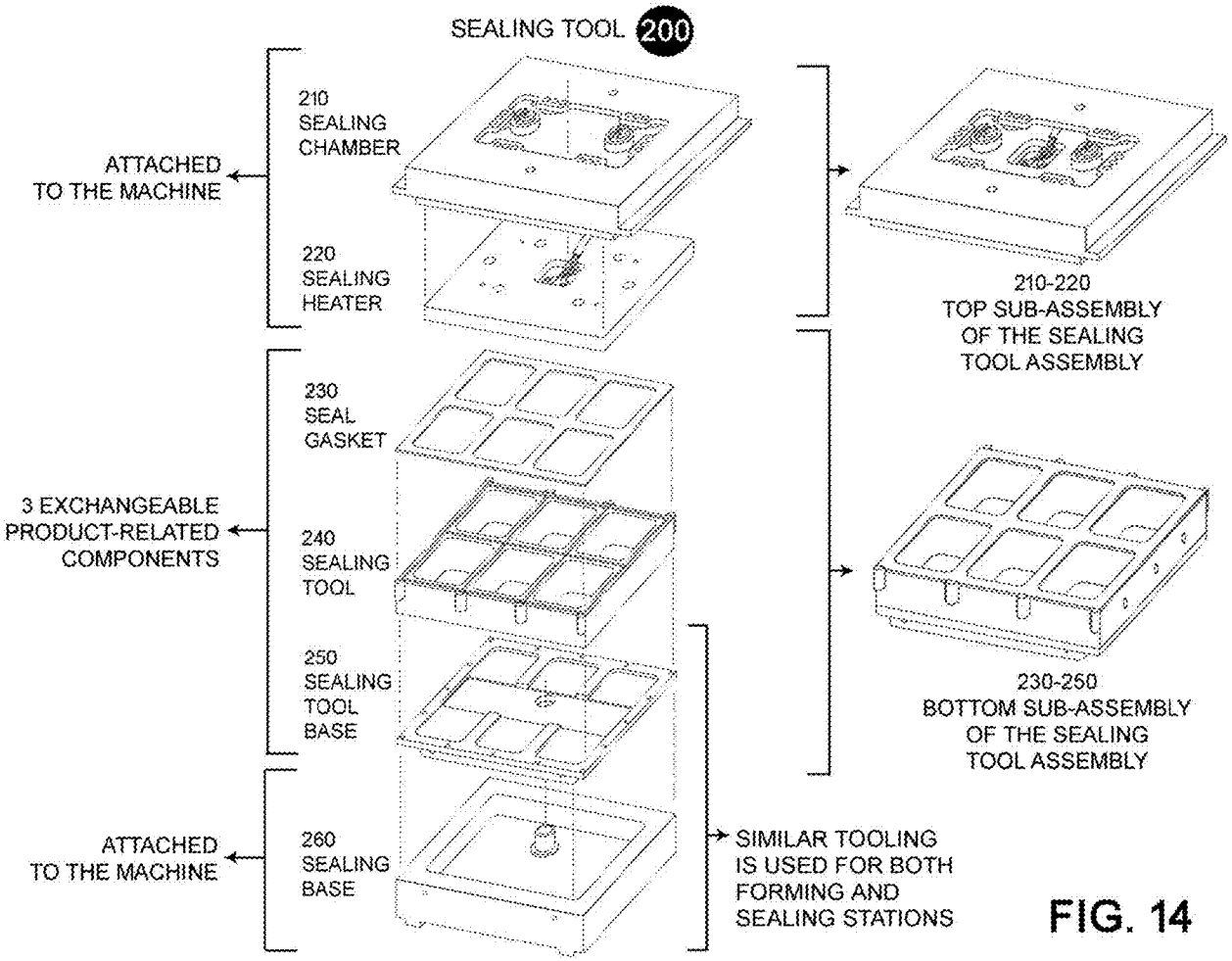
FIG. 14 is a fully exploded view of the sealing tool assembly, providing a perspective view of each individual component and two sub-assemblies: 210-220 the top sub-assembly of the sealing tool assembly (comprising of: 210 sealing chamber, 220 sealing heater; annotated "attached to the machine") indicating that this sub-assembly does not have to be removed during the tool exchange process; 230-250 the bottom sub-assembly of the sealing tool assembly (comprising of: 230 sealing gasket, 240 sealing tool, 250 sealing o-ring tool base; annotated "3 exchangeable product-related components") indicating that this sub-assembly is a part of the tool exchange process, necessary to accommodate different shapes/sizes of packaged products; and 260 sealing base (annotated "attached to the machine") indicating that this sub-assembly does not have to be removed during the tool exchange process, in accordance with an exemplary embodiment of the present invention.

The sealing tool assembly 100, is divided into two sub-assemblies: (1) a top sub-assembly 210-220 (shown in FIGS. 7 and 14), comprising of: (i) a sealing chamber 210 (ii) and a sealing heater 220; (2) and a bottom sub-assembly 230-250 (shown in FIGS. 8 and 14), comprising of (i) a seal gasket 230, (ii) a sealing tool 240, (iii) a sealing o-ring base 250.

Figure 7:
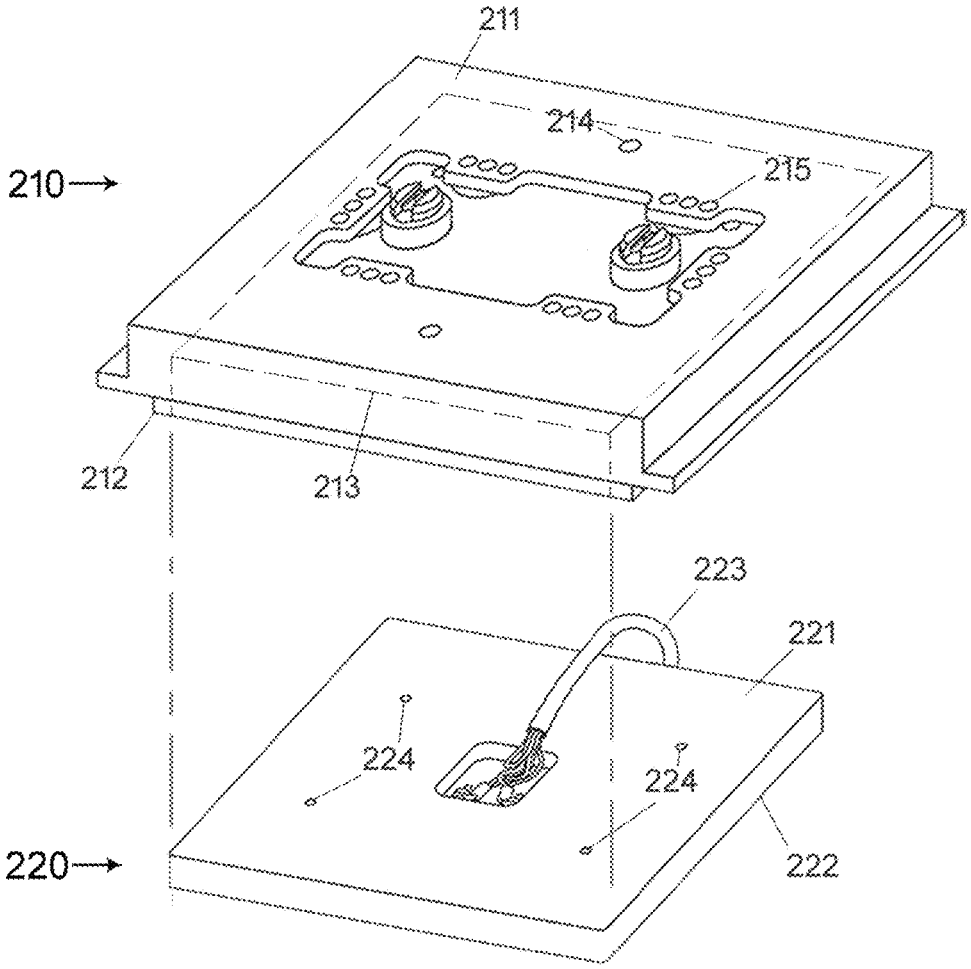
FIG. 7 is an exploded view of the top sub-assembly of the sealing tool assembly, comprising of: 210 sealing chamber; 220 sealing heater, in accordance with an exemplary embodiment of the present invention.

The top sub-assembly's sealing chamber 210, shown in FIG. 7 (comprising of a top surface 211, a bottom surface 212, a heater pocket 213, mounting holes 214, and retaining clearance holes 215) is fixedly attached to the sealing heater 220 (comprising of a top surface 221, a bottom surface 222, a power cable 223, retaining threaded holes 224) by connecting using screws (or other mechanical means) the clearance holes 215 to the threaded holes 224, located on the top surface 221 of the sealing heater 220.

The sealing chamber 210 is fixedly attached to the sealing station 370 of the machine 300, using screws (or other mechanical means) and the mounting holes 214, shown in FIG. 7. Wherein said sealing station 370 provides means of controllable vertical motion of said sealing chamber 210, including but not limited to pneumatic cylinders 391 and/or electric motors 392.

Figure 8:
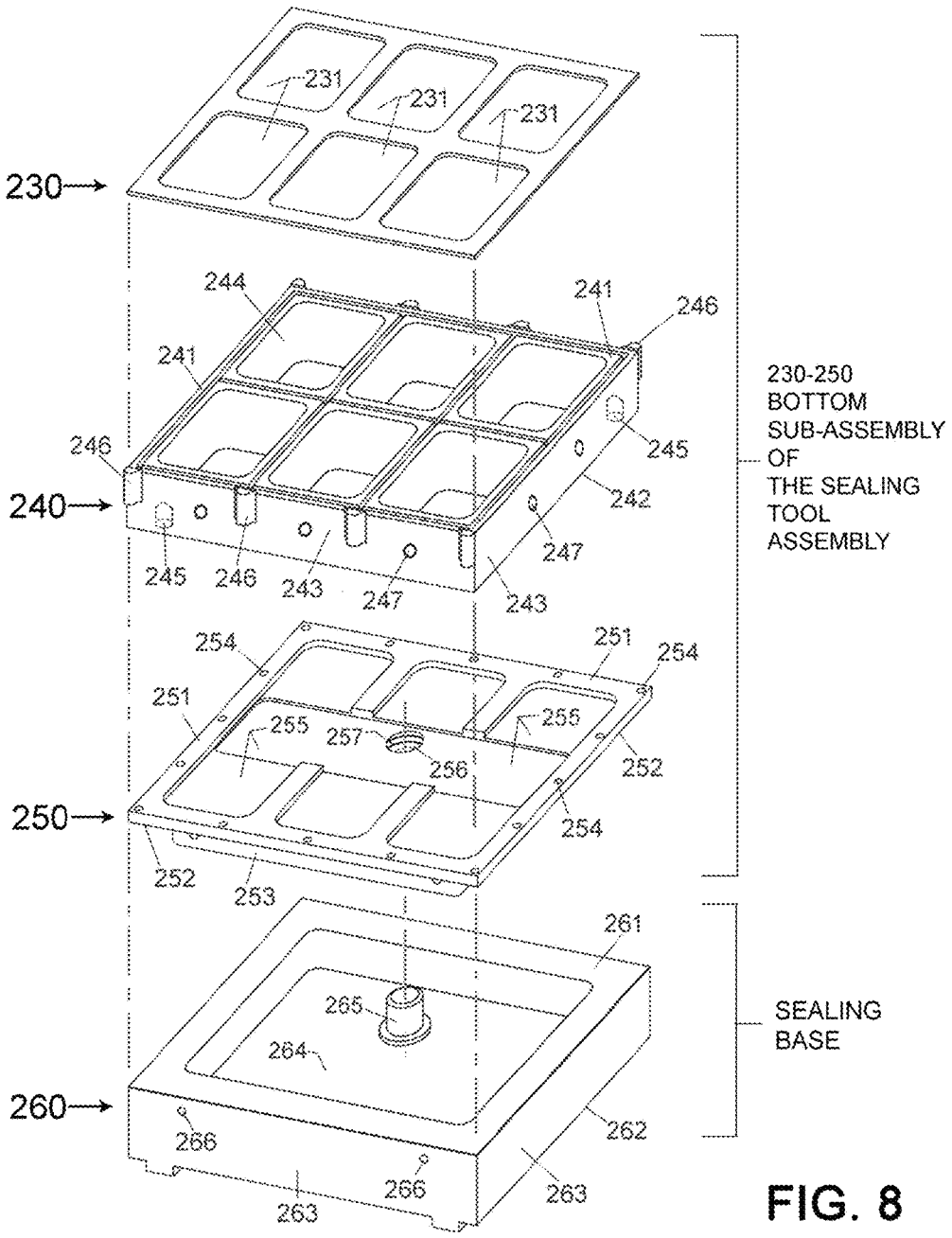
FIG. 8 is an exploded view of the bottom sub-assembly of the sealing tool assembly (comprising of: 230 sealing gasket, 240 sealing tool, 250 sealing o-ring tool base), and 260 sealing tool base, in accordance with an exemplary embodiment of the present invention.

As shown in FIGS. 8, 19 and 20, the bottom sub-assembly's seal gasket 230 (comprising of forming cutouts 231) is positioned on the top surface of the sealing tool 240 (comprising of top surface 241, bottom surface 242, side walls 243, sealing pockets 244, retaining threaded holes 245, squeeze limiters 246, and handle threaded holes 247).

Said sealing tool 240 (shown in FIGS. 8, 19 and 20), is fixedly attached to the sealing o-ring tool base 250, shown in FIGS. 8, 14, 15, 16, 17, 19 and 20, (comprising of top surface 251, bottom surface 252, flange 253, retaining clearance holes 254, pocket shapes 255, o-ring hole 256, o-rings 257), wherein said connection between the sealing tool 240 and the o-ring-tool base 250 is via the retaining clearance holes 254 and the retaining threaded holes 245, connected with screws (or other mechanical means and/or adhesives).

The bottom sub-assembly 230-250 is releasably attached to a sealing base 260 (comprising of top surface 261, bottom surface 262, side walls 263, pocket 264, nozzle 265, and retaining threaded holes 266). The sealing base 260 is fixedly attached to the machine 300, via a hard air fitting. Said fitting is connecting the vacuum pump 393 to the inlet of the nozzle 265, located in the bottom surface 262 of the sealing base 260.

Unlike the forming station 340, the sealing station 370 is positioned toward the end of the machine's 300 operational flow, and receives the packaging film 310 from the top film roll unwind station 360 (shown in FIGS. 9, 10, 11 and 12), Wherein said packing film 310 is utilized to close off the top portion the package which, is indexed into the sealing station 370, after being filled with the product at the fill station 350 (ref. FIGS. 9 and 10).

At the sealing station 370, the pneumatic cylinders 391 move the top sub-assembly 210-220 downward, and the bottom sub-assembly 230-250 upward. This action sandwiches together the pre-filled, bottom portion of the package and the top layer of the packaging film 310, between the sealing chamber 210 and the seal gasket 230 (ref. in FIGS. 10 and 19).

To ensure proper sealing action, the full weight and force of the sealing chamber 210 presses down of the gasket 230, causing the premature destruction of the gasket 230, and necessitating frequent replacements thereof. To prevent the premature destruction of the gasket 230, a plurality of squeeze limiters 246 are attached to the sealing tool 240. Specifically, the squeeze limiters 246 are the rectangular stop blocks protruding from the side walls 243 of the sealing tool 240, referenced in FIGS. 8 and 20. Said squeeze limiters 246 extend above the top surface of the sealing tool 240, absorbing some of the chamber's 210 force, preventing it from bottoming out on the seal gasket itself 230.

Next, the machine 300 initiates the vacuum and vent cycle, generated by the vacuum pump 393 and the power/control station 390. The vacuum and vent cycle travels from the pump system 393 into the nozzle 265 of the sealing base 260 (shown in FIGS. 8, 15 and 19), and from said nozzle 265 into the o-ring tool base 250.

Replicating the forming tool 200 design, the connection between said nozzle 265 and the base 250 is via an o-ring hole 256 (shown in FIGS. 16 and 17), which holds a plurality of o-rings 257, allowing said nozzle 265 to slidably fit inside said o-ring hole 256, enabling the access of said vacuum and vent cycles to the top surface 251 of the forming o-ring tool base 250.

At the o-ring tool base 250, the vacuum and vent cycles is redistributed, via the shallow pocket shapes 255 (shown in FIGS. 16 and 19), and directed into the sealing pockets 244 of the sealing tool 240.

Once inside the sealing tool pockets 244, the vacuum/vent cycle is used to evacuate the excess air from the interior of the package. Also, the heat generated by the sealing heater 220 held by the sealing chamber 210, is projected downward into the sealing base 240, is used to seal together the first and the second layer of the packaging film 310 (ref. FIGS. 10 and 19), finalizing the enclosure of the product, and completing the packaging process.

If desired, the machine 300 may be converted to package different products. Said products may be of different shapes and sizes, as the forming 100 and the sealing 200 tooling may be altered, and the machine's index length may be adjusted to accommodate new products.

To prepare the machine 300 for packaging of different products, the operator must exchange ("tool changeover") two items: 1) the bottom sub-assembly of the forming tool assembly 130-150; 2) the bottom sub-assembly of the sealing tool assembly 230-250. Said tool changeover, shown in FIG. 11, does not require exchange of the forming 160 and/or sealing 260 base, nor the exchange of the top sub-assemblies. Moreover, the tool changeover may be done manually due to the relatively low weight of the tooling, and the usage of the removable handles 147 and 248. Said handles, are attachable via the handle threaded holes 146 to the side walls 143 of the forming tool 140, and via the handle threaded holes 247 to the side walls 243 of the sealing tool 240.

What is claimed is:

1. A forming and sealing tool assembly with an o-ring tool base used in a horizontal, form, fill and seal packaging machine, comprising:

A) a packaging machine, having
- (a) a forming station for mounting a forming tool,
- (b) a sealing station for mounting a sealing tool,
- (c) a means for feeding a first layer of packaging film for forming a bottom portion of a package and a means for feeding a second layer of packaging film for forming a top portion of a package,
- (d) a means for indexing said packaging film in horizontal plane of the packaging machine, in and out of the forming tool and the sealing tool stations,
- (e) a means for filling said pre-formed bottom portion of the package with product,
- (f) a means for generating vacuum and vent cycles for removing the air of the package,
- (g) a means for engaging said forming and the sealing tool stations into a programmable, cyclical, vertical motion, for enabling said forming and the sealing tool assemblies to engage the packaging film to form and seal the packaging film around a product, thereby creating air free packages, and
- (h) a means of separating groups of sealed packages into individual packages;

B) a forming tool assembly, comprising of
- (a) a forming base fixedly attached to the packaging machine's forming station, having (i) a top surface,
(ii) a bottom surface,
(iii) a plurality of side walls,
(iv) a pocket for reducing the weight of the forming tool,
(v) a nozzle for enabling flow of the vacuum and vent cycles, and
(vi) a means for fixedly attaching the forming base to the packaging machine;

(b) a forming o-ring tool base releasably attached to the forming base, comprising of
(i) a top surface,
(ii) a bottom surface,
(iii) an o-ring hole housing a plurality of o-rings made to slidably fit the nozzle of the forming base enabling access of said vacuum and vent cycles toward the top surface of the forming o-ring tool base,
(iv) a plurality of pocket shapes for redistributing said vacuum and vent cycles coming out of the nozzle of the sealing base, and
(v) a means for releasably attaching said forming o-ring tool base to the forming base;

(c) a forming tool fixedly attached to the top surface of the forming o-ring tool base, comprising of
(i) a top surface,
(ii) a bottom surface,
(iii) a plurality of side walls,
(iv) a plurality of forming pockets in form corresponding to the pocket shapes located inside the forming o-ring tool base, made to hold forming tool inserts, and
(v) a means for fixedly attaching said forming tool to the forming o-ring tool base;

(d) a plurality of forming tool inserts shaped to accommodate the shape of a product being packaged, designed to slidably fit inside the forming pockets of the forming tool, comprising of
(i) a multitude of side panels,
(ii) a multitude of bottom panels, and
(iii) a multitude of air holes located in said side and bottom panels, for allowing said vacuum and vent cycles to access the first layer of packaging film and pull said film up against the side and the bottom panels of said tool inserts, causing said film to retain the shape of the forming tool inserts;

(e) a bottom sub-assembly of said forming tool assembly, consisting essentially of
(i) the plurality of forming tool inserts,
(ii) the forming tool, and
(iii) the forming o-ring tool base;

(f) a forming heater for generating heat used for forming the packaging film, comprising of
(i) a top surface,
(ii) a bottom surface, and
(iii) a power cable for supplying electricity generating said heat;

(g) a forming chamber having
(i) a top surface fixedly attached to the packaging machine's forming station,
(ii) a bottom surface holding said forming heater lowered with each index of the machine to make contact with the forming tool to transfer heat into the forming pockets housing the forming inserts made to pull said film up against the side and the bottom panels of said tool inserts, causing said film to retain the shape of the forming tool inserts, and
(iii) a means of fixedly attaching said forming chamber to the packaging machine and to said forming heater;

(h) a top sub-assembly of said forming tool assembly, consisting essentially of
(i) the forming heater, and
(ii) the forming chamber;

C) a sealing tool assembly comprising of (a) a sealing base fixedly attached to the packaging machine's sealing station, having
(i) a top surface,
(ii) a bottom surface,
(iii) a plurality of side walls,
(iv) a pocket for reducing the weight of the forming tool,
(v) a nozzle for enabling flow of the vacuum and vent cycles, and
(vi) a means for fixedly attaching the sealing base to the packaging machine;

(b) a sealing o-ring tool base releasably attached to the sealing base, having
(i) a top surface,
(ii) a bottom surface,
(iii) an o-ring hole housing a plurality of o-rings made to slidably fit inside the nozzle of the sealing base enabling access of said vacuum and vent cycles toward the top surface of the sealing o-ring tool base,
(iv) a plurality of pocket shapes for redistributing said vacuum and vent cycles coming out of the nozzle of the sealing base, and
(v) a means for releasably attaching said sealing o-ring tool base to the sealing base;

(c) a sealing tool fixedly attached to the top surface of the sealing o-ring tool base, having
(i) a top surface,
(ii) a bottom surface,
(iii) a plurality of side walls,
(iv) a plurality of sealing pockets open to the plurality of pocket shapes of the sealing o-ring tool base, enabling access to said vacuum and vent cycles into said sealing pockets,
(v) a plurality of squeeze limiters, fixedly attached to said side walls near the top surface of the sealing tool, for protecting a seal gasket by absorbing the weight of a sealing chamber pushing down on said seal gasket with each index of the packaging machine, and
(vi) a means for fixedly attaching said sealing tool to the sealing o-ring tool base;

(d) a seal gasket disposed on the top surface of the sealing tool made to contact a sealing chamber with each index of the machine, having
(i) a plurality of cutouts corresponding with the shapes of the sealing pockets of the sealing tool for sealing off the outside areas of the packages and preventing leaks of said vacuum and vent cycles;

(e) a bottom sub-assembly of the sealing tool assembly, consisting essentially of
(i) the seal gasket,
(ii) the sealing tool, and
(iii) the sealing o-ring tool base;

(f) a sealing heater for generating heat used for sealing the second layer of the packaging film, having
(i) a top surface,
(ii) a bottom surface, and
(iii) a power cable for supplying electricity generating said heat;
(g) a sealing chamber having
(i) a top surface fixedly attached to the packaging machine's sealing station,
(ii) a bottom surface holding said sealing heater lowered with each index of the machine to sandwich between said chamber and the seal gasket such that it seals the first and the second layer of the packaging film together, and
(iii) a means of fixedly attaching said sealing chamber to the packaging machine and to said sealing heater;
(h) a top sub-assembly of said sealing tool assembly, consisting essentially of
(i) the sealing heater, and
(ii) the sealing chamber;
D) a means of manually removing from the packaging machine
(a) the bottom sub-assembly of the forming tool assembly and
(b) the bottom sub-assembly of the sealing tool assembly.

2. The forming and sealing tool assembly of claim 1 wherein:
said means for feeding the packaging film is via a bottom film roll unwind and a top film roll unwind stations.

3. The forming and sealing tool assembly of claim 1 wherein:
said means for indexing the packaging film in horizontal plane of the packaging machine is via a conveying chain.

4. The forming and sealing tool assembly of claim 1 wherein:
said means for filling said pre-formed bottom portion of the package with product is via an automated machine of manual labor.

5. The forming and sealing tool assembly of claim 1 wherein:
said means for generating said vacuum and vent cycles for removing the air of the package is via a vacuum pump.

6. The forming and sealing tool assembly of claim 1 wherein:
said means for engaging the forming tool and the sealing tool stations into a programmable, cyclical, vertical motion, is via pneumatic cylinders.

7. The forming and sealing tool assembly of claim 1 further comprising:
a hard air fitting for connecting the nozzle's inlet to the vacuum pump, located on the bottom surface of the forming base, and on the bottom surface of the sealing base to the vacuum pump.

8. The forming and sealing tool assembly of claim 1 wherein:
said means for fixedly-attaching the forming base and the sealing base to the packaging machine is via said hard air fitting.

9. The forming and sealing tool assembly of claim 1 further comprising:
a plurality of retaining threaded holes located in the side walls of the forming base and in the side walls of the sealing base made to accept a plurality of threaded inserts.

10. The forming and sealing tool assembly of claim 9 further comprising:
a flange formed from the bottom surface of the forming o-ring tool base and the bottom surface of the sealing o-ring tool base.

11. The forming and sealing tool assembly of claim 10 wherein:
said means for releasably attaching the forming o-ring tool base to the forming base and the sealing o-ring tool base to the sealing base is by using said threaded inserts.

12. The forming and sealing tool assembly of claim 1 further comprising:
A) a plurality of retaining clearance holes located in the top surface of said forming o-ring tool base,
B) a plurality of retaining clearance holes located in the top surface of the sealing o-ring tool base,
C) a plurality of retaining threaded holes located in the bottom surface of said forming tool, and
D) a plurality of retaining threaded holes located in the bottom surface of said sealing tool.

13. The forming and sealing tool assembly of claim 1 wherein:
said means for fixedly attaching said forming tool to the forming o-ring tool base is by using a plurality of screws.

14. The forming and sealing tool assembly of claim 1 wherein:
said means for fixedly attaching said sealing tool to the sealing o-ring tool base is by using a plurality of screws.

15. The forming and sealing tool assembly of claim 1 further comprising:
A) a plurality of mounting holes penetrating the top surface and the bottom surface of the forming chamber,
B) a plurality of mounting holes penetrating the top surface and the bottom surface of the sealing chamber,
C) a plurality of retaining clearance holes penetrating the top surface and the bottom surface of the forming chamber, and
D) a plurality of retaining clearance holes penetrating the top surface and the bottom surface of the sealing chamber.

16. The forming and sealing tool assembly of claim 1 wherein:
said means of fixedly attaching said forming chamber to the packaging machine and to said forming heater is by using a plurality of screws.

17. The forming and sealing tool assembly of claim 1 wherein:
said means of fixedly attaching said sealing chamber the packaging machine and to said sealing heater is by using a plurality of screws.

18. The forming and sealing tool assembly of claim 1 further comprising:
A) a plurality of handle threaded holes located in the side walls of said forming tool,
B) a plurality of handle threaded holes located in the side walls of said sealing tool, and
C) a plurality of removable handles having a threaded end of size corresponding to heretofore handle threaded holes.

19. The forming and sealing tool assembly of claim 1 wherein:
said means of manually removing from the packaging machine the bottom sub-assembly of the forming tool assembly and the bottom sub-assembly of the sealing tool assembly is via the threaded holes and the corresponding removable handles of claim 18.

20. The forming and sealing tool assembly of claim 1 wherein:

said means of separating groups of sealed packages into individual packages is via a cut station whereby said packaging machine uses the forming tool assembly to form the bottom portion of the package, and the sealing tool assembly to apply the top layer of the packaging film to said bottom portion of the package, thereby completing assembly of groups of sealed packages, which are separated into individual packages by using the cut station.

* * * * *